US006259433B1

(12) United States Patent
Meyers

(10) Patent No.: US 6,259,433 B1
(45) Date of Patent: Jul. 10, 2001

(54) DIGITAL OPTICAL JOYSTICK WITH MECHANICALLY MAGNIFIED RESOLUTION

(76) Inventor: Norman H. Meyers, P.O. Box 1792, Rancho Santa Fe, CA (US) 92067

( * ) Notice: Subject to any disclaimer, the term of this patent is extended or adjusted under 35 U.S.C. 154(b) by 0 days.

(21) Appl. No.: 08/645,511

(22) Filed: May 14, 1996

(51) Int. Cl.[7] ..... G09G 5/08

(52) U.S. Cl. ..... 345/161; 345/156; 463/38

(58) Field of Search ..... 345/161, 156, 345/157, 163; 250/231.16; 364/508; 341/116; 318/602, 661; 340/347; 463/38

(56) References Cited

U.S. PATENT DOCUMENTS

| | | | | |
|---|---|---|---|---|
| 3,770,915 | | 11/1973 | Bennett et al. | 200/6 A |
| 4,142,180 | | 2/1979 | Burson | 340/709 |
| 4,148,014 | | 4/1979 | Burson | 340/709 |
| 4,161,726 | | 7/1979 | Burson | 340/365 R |
| 4,306,232 | | 12/1981 | Burson | 340/706 |
| 4,488,017 | | 12/1984 | Lee | 200/5 R |
| 4,493,992 | | 1/1985 | Geller | 250/221 |
| 4,501,939 | | 2/1985 | Hyltin et al. | 200/6 A |
| 4,533,827 | | 8/1985 | Fincher | 250/211 |
| 4,607,159 | | 8/1986 | Goodson et al. | 250/221 |
| 4,685,678 | | 8/1987 | Frederiksen | 273/148 B |
| 4,686,361 | | 8/1987 | Bard | 250/221 |
| 4,707,683 | * | 11/1987 | Yao | 340/347 |
| 4,731,530 | | 3/1988 | Mikan | 250/229 |
| 4,855,704 | | 8/1989 | Betz | 336/132 |
| 4,856,785 | | 8/1989 | Lantz et al. | 273/148 B |
| 4,891,764 | * | 1/1990 | McIntosh | 364/508 |
| 4,958,071 | | 9/1990 | Scott-Jackson et al. | 250/229 |
| 4,963,733 | * | 10/1990 | Spaulding | 250/231.16 |
| 5,117,102 | | 5/1992 | Mitchell | 250/229 |
| 5,121,116 | * | 6/1992 | Taniguchi | 341/116 |
| 5,168,268 | | 12/1992 | Levy | 340/709 |
| 5,204,600 | * | 4/1993 | Kahkosha | 318/602 |
| 5,225,831 | | 7/1993 | Osborn | 341/20 |
| 5,252,968 | | 10/1993 | Donovan | 390/870.28 |
| 5,457,371 | * | 10/1995 | Gordon | 318/661 |
| 5,558,329 | * | 9/1996 | Liu | 345/161 |
| 5,589,854 | * | 12/1996 | Tsai | 345/161 |
| 5,640,177 | * | 6/1997 | Hsu | 345/161 |
| 5,675,359 | * | 10/1997 | Anderson | 345/161 |
| 5,805,140 | * | 9/1998 | Rosenberg et al. | 345/161 |
| 5,821,920 | * | 10/1998 | Rosenberg et al. | 345/161 |

* cited by examiner

*Primary Examiner*—Bipin Shalwala
*Assistant Examiner*—David L. Lewis
(74) *Attorney, Agent, or Firm*—Renner, Otto, Boisselle & Sklar, LLP

(57) ABSTRACT

A one or multiple axis digital joystick using incremental optical encoding with mechanical means for magnifying motion of the encoded medium to achieve higher resolution than otherwise attainable with the same optoelectronic components. Excellent linearity between shaft rotation and digital output results from elimination of backlash and preservation of rotary-only motion in the mechanical linkage between shaft and encoder disc. All electronic functions are implemented in a low-cost internal microcomputer that interfaces in serial or parallel mode with many system computers or microcomputers without additional circuitry. The microcomputer converts the incrementally encoded signals from the optoelectronic devices into absolute shaft-position information in a fail-safe manner. The joystick can be operated very rapidly without error because the encoded pulses to be counted are applied to microcomputer inputs that store the occurrence of each pulse until the microcomputer can process them. The stored program also ensures that each joystick has the same full-scale outputs despite minor mechanical variations from one joystick to another. In addition, it corrects errors caused by hysteresis in some of the optoelectronic components. The resulting joystick is field replaceable without any adjustments or recalibration.

12 Claims, 9 Drawing Sheets

FIG. 2A
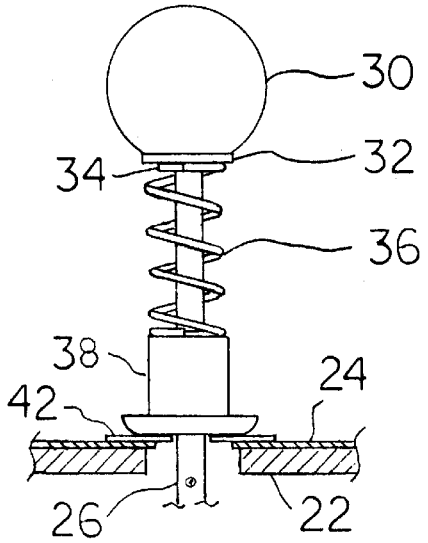
FIG. 2B
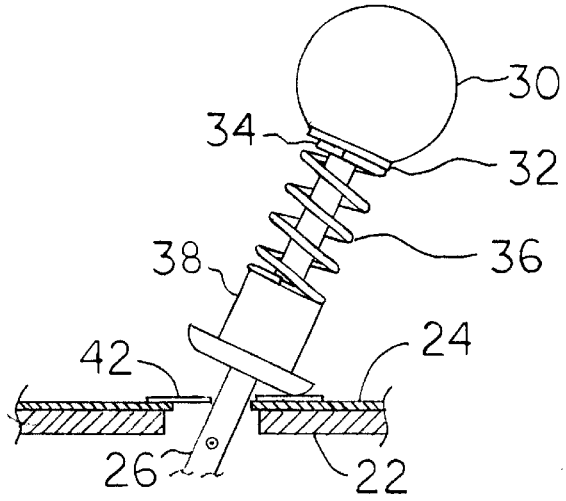
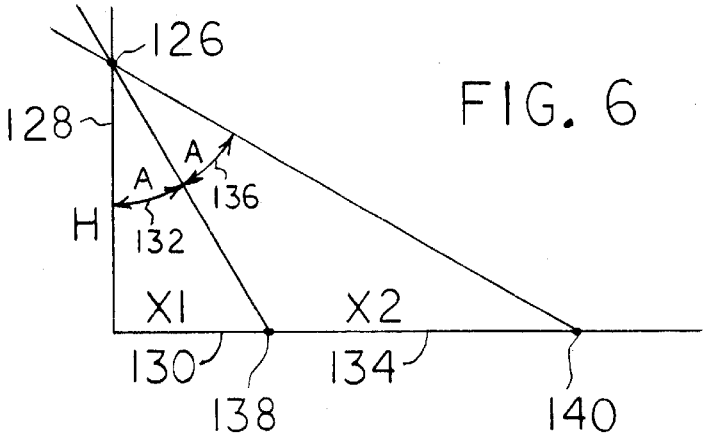
FIG. 6

DIGITAL OPTICAL JOYSTICK WITH MECHANICALLY MAGNIFIED RESOLUTION

BACKGROUND

1. Field of Invention

This invention relates to a one or multiple axis joystick that uses incremental optical encoding and the principle of mechanical advantage to obtain a digital output of enhanced resolution that is a reliable measure of absolute shaft position and which can be read by a computer without interface circuitry.

2. Description of Prior Art

There is much prior art related to the use of joysticks as man-to-machine input devices. A variety of joysticks have been used to input commands to video game controllers or to control the motion of a cursor on a video screen. Examples include U.S. Pat. No. 4,488,017 (Lee) and U.S. Pat. No. 4,501,939 (Hyltin et al). Devices of this type employ electrical contacts or switches which are actuated by motion of the joystick shaft. Most of these joysticks are able to sense the motion of the shaft in one of four or eight different radial directions but do not sense how far the shaft has moved in the chosen direction. The output signal is digital in the sense that each contact or switch actuated by shaft motion is either open or closed. However, the digital resolution is exceedingly low (one binary bit of information for each of the eight detectable directions of shaft motion). Also, the electrical contacts in mechanically operated switches are subject to wear, corrosion, contamination, pitting, and contact bounce. Joysticks of this type lack the resolution and reliability needed for control of powered wheelchairs, fork lifts, machine tools, earth-moving machines, robotic devices, etc.

Efforts have been made to improve the resolution of digital joysticks that utilize mechanically actuated electrical contacts by increasing the number of contacts. One example is described in related U.S. Pat. Nos. 4,142,180; 4,148,014; 4,161,726; and 4,306,232 (Burson). Four-bit resolution along each of two orthogonal axes is obtained with eight sets of contacts. Other examples of multi-contact joysticks are described in U.S. Pat. No. 3,770,915 (Bennett et al) and U.S. Pat. No. 5,225,831 (Osborn). In each case of this type, the resolution achievable increases with the number of contacts employed but the joystick becomes mechanically complex if high resolution is needed. Note that the mechanical precision required doubles with each additional bit of resolution. Furthermore, the reliability of the joystick decreases and the cost increases as the number of contacts is raised to improve resolution.

Optoelectronic devices (typically pairs of light emitting diodes and phototransistors) have been used to improve the reliability of digital joysticks. U.S. Pat. No. 5,117,102 (Mitchell) describes such a joystick. It is intended as a direct replacement for the simpler joysticks employing mechanically actuated electrical contacts. As such, its resolution is limited to one binary bit in each of eight detectable directions. Another example of a digital joystick employing optical switches is disclosed in U.S. Pat. No. 4,856,785 (Lantz et al.). This device is intended as a direct replacement for the joysticks of the preceding paragraph that use multiple mechanically actuated electrical contacts for improved resolution. This patent describes a system employing six optical switches that provide slightly less than three bits of resolution along each of a pair of orthogonal axes. As with its mechanical counterparts, this approach can achieve higher resolution with more optical switches at the expense of rapidly escalating complexity and cost. Another disadvantage of this prior art device (Lantz et al.) is that it includes, along with some other prior art devices, an inherent source of non-linearity due to its conversion of shaft rotation to rectilinear motion of plates transporting the encoded medium. This problem will be discussed in detail later since the present invention removes it.

In an effort to achieve the very high resolution of joysticks employing resistive potentiometers while overcoming their well known reliability problems, non-contact analog joysticks have been developed. Some use inductive techniques while others exploit optoelectronic devices. U.S. Pat. No. 4,685,678 (Frederiksen) and U.S. Pat. No. 4,855,704 (Betz) disclose joysticks in which motion of the shaft alters the inductance of a coil which is part of an oscillator circuit. Then, a property of the oscillator (frequency, amplitude, or phase) is processed electronically to obtain an indication of shaft position. Variable transformer coupling between an excitation coil, moved by the joystick shaft, and fixed sensor coils is employed in U.S. Pat. No. 4,434,412 to obtain an analog signal indicative of shaft position. These approaches are more reliable than resistive potentiometers but are inherently non-linear (i.e., unlike resistive potentiometers which are normally fabricated to be very linear, the analog output signal from these inductive devices does not vary linearly with joystick shaft position). Electronic compensation of this inherent non-linearity is feasible but adds to cost and complexity. Furthermore, the analog signal must be processed through interface circuitry, typically including an analog-to-digital converter, before it can be used in a modern control system, almost all of which use digital microprocessors or microcomputers.

The analog joysticks employing optoelectronic devices suffer from the same drawbacks as the inductive devices just described. That is, the analog output signals tend to vary in a non-linear manner with changes of shaft position and the signal must be processed through interface circuitry before it can be utilized in a digital control system. Examples of this type of joystick are disclosed in U.S. Pat. No. 4,533,827 (Fincher); U.S. Pat. No. 4,607,159 (Goodson et al); U.S. Pat. No. 4,686,361 (Bard); and U.S. Pat. No. 4,731,530 (Mikan).

Historically, analog computers gave way to digital computers. Analog measuring instruments have been largely supplanted by digital instruments. Today, digital television is on the brink of replacing analog television. The reasons are numerous and some of them apply to joysticks. They include better immunity to noise, elimination of drift, improved repeatability of output readings (for a given joystick shaft position) from one reading to the next and one device to the next, greater accuracy, higher reliability, ease of transmission of the results, and lower cost. It seems probable that analog joysticks will go the way of analog computers and be displaced by digital devices like that of the present invention.

Many of the disadvantages of the preceding approaches to joystick implementation can be overcome by the use of digital optical encoding. Digital optical encoders are well developed, reliable, can be made very linear, and can interface directly with microprocessors or microcomputers without extra circuitry. There are two basic types of digital optical encoders, absolute and incremental. Both types can be very linear because the linearity is accurately built into the encoding disc or strip by photographic means. Absolute encoders use one track of an optically encoded disc or strip plus a light emitter-detector pair for each binary bit of resolution desired. Thus, the output of such an encoder is a binary word with all bits read in parallel to obtain an absolute indication of the position of the encoded disc or strip at that instant. Like the digital devices described earlier employing multiple switch contacts, the precision required on the optically encoded disc or strip doubles with each additional bit of resolution. Also, the demands placed upon the emitter-detector pairs escalate geometrically as the number of bits is increased. Hence, the complexity, size, and cost rise rapidly as the resolution increases and absolute encoders generally have not been exploited for joystick applications. Note, however, that the device described earlier as disclosed in U.S. Pat. No. 4,856,785 (Lantz et al.) can be viewed as a joystick employing absolute optical encoding but with relatively low resolution. Absolute digital optical encoders are used extensively in those precision control applications where the need for accurate absolute position sensing outweighs the related cost.

A lower cost alternative to the digital absolute encoder is the digital incremental encoder. This technique employs two tracks of an optically encoded disc or strip plus two light emitter-detector pairs. The two tracks are offset in phase by 90 degrees and well known techniques are used to derive a direction-of-motion signal from the relative phase relationship of the two optically derived signals. The signal from either track is a train of pulses that is counted electronically and the direction-of-motion signal tells the counter whether to count up or down. Changes in the count provide a measure of changes in position of the encoded disc or strip (and, hence, of the joystick shaft) but the count at any instant does not provide an absolute indication of the position of the encoded disc or strip at that instant (hence the name, incremental encoding). This difficulty is overcome partially by addition of a third track encoded at any desired position with a single pulse that clears or presets the counter at that position. A limitation of this third track approach is that there is no absolute position information available until the counter has received the clear or preset pulse the first time. Thus, when power first comes on, the counter might be reading anything and the joystick shaft might be anywhere and, therefore, no position information is available. This is unacceptable in many joystick applications; a powered wheelchair, for example, because the chair could "take off" with arbitrary direction and speed when first powered up. It would be simple enough to clear the counter automatically upon powering up. This would solve the problem provided that the joystick shaft was always in the neutral position at that time. But, in many cases (the power chair case, for example), there can be no such guarantee. Therefore, the application of incremental optical encoding to a joystick requires a fail-safe means of converting the incrementally encoded signals into absolute position information. The present invention provides a means for doing this.

The resolution attainable with an incremental encoder matches that from an absolute encoder if the density and precision of both of the phase related tracks of the incremental encoder match that of the absolute encoder's most dense track (the track of its highest order bit). Clearly, the cost advantage of the incremental encoder over the absolute encoder increases as the number of bits of resolution increases.

U.S. Pat. No. 4,958,071 (Scott-Jackson et al) discloses a mechanically complex two-axis joystick that uses photographic film as the encoded medium for implementing incremental optical encoding. This patent does not disclose any method for converting the incrementally encoded signals into absolute position information, a requirement in most practical applications of a joystick. Note also that the resolution provided by the method disclosed, while potentially very high, is limited by the density of the pattern encoded on the film and the ability of the optical components to read that pattern correctly. This is important because the present invention overcomes this significant limitation inherent in the prior art, as will be shown.

Digital incremental optical encoding is widely used in devices designed to control the position of a cursor on a video screen. A cursor control device is commonly called a mouse or trackball. Examples are described in U.S. Pat. Nos. 4,464,652 and 5,168,268 (Levy). The mouse or track ball is a fundamentally different device from the type of joystick that outputs an absolute indication of shaft position, even though incremental optical encoding can be applied to either. In the case of a mouse, it is not necessary to obtain absolute position information from the incrementally encoded signals. The user derives this information by noting the position of the cursor on the screen. Then, the mouse is moved manually until the cursor is in the desired position. It is not necessary for the electronics to count the pulses from the mouse, although some electronic schemes used with a mouse do count pulses, because the user just continues to move the mouse and generate more pulses until the cursor is in the desired location. The initial location of the cursor upon power-up is not very important so long as it is somewhere in the field of view.

The signals from an incremental optical encoder can be processed by a microprocessor or microcomputer as in U.S. Pat. No. 4,493,992 (Geller). This patent discloses a mode of operation in which a microcomputer determines the direction of motion from the signals of the two phase-related tracks and then advances a software counter in the proper direction by one count for each pulse received from one of the tracks. A continuous software loop performs these operations sequentially for the two axes of the mouse (trackball) described. This is a simple scheme that works well provided the input pulses don't occur too rapidly. A count can be missed if a pulse from one axis appears and disappears while the sequentially operating software is processing a pulse from the other axis. The most stressful condition occurs when both axes are feeding rapid pulses to the microcomputer simultaneously. The parallel port of the microcomputer, which receives all of the input signals from the encoders in Geller's disclosure, is level sensitive rather than edge sensitive and can not retain the fact that a pulse occurred on one or more of its bit lines. The software must be reading these input bit lines while the pulse is present or the pulse is lost. The speed of the microcomputer is such that this is not a serious problem in normal operation of a mouse. However, a joystick employing incremental optical encoding that is slammed rapidly from neutral to full scale along both axes at once can lose a number of counts if the method of the referenced patent is used. The present invention discloses a method that largely overcomes this limitation of the prior art.

Another approach to processing the signals from a mouse that uses incremental optical encoding is disclosed in U.S. Pat. No. 5,252,968 (Donovan). Here an application specific integrated circuit (ASIC), sometimes called a custom IC, is used to receive the signals from the optoelectronics of the encoders and convert these into cursor control outputs. This is fundamentally different from Geller's approach in that the ASIC is not a general purpose device operating under control of a stored application program. The ASIC approach, while powerful and potentially very fast, has a very high development cost that can be justified only in a very high volume application. Instead, the present invention discloses means for accomplishing all of the electronic signal processing desired with a single, low cost microcomputer available on the market as a standard product.

OBJECTS OF THE INVENTION

The present invention improves upon the prior art described by accomplishing the following.

1. An object of this invention is to provide a one or multiple axis digital joystick that exploits the advantages of incremental optical encoding and provides a fail-safe method of obtaining absolute position information from the incrementally encoded signals.

2. Another object of this invention is to increase joystick digital resolution by utilizing the principle of mechanical advantage; via a gear train or belt and pulley scheme, etc; in such a way that the resulting joystick has higher resolution than could be achieved with the same optoelectronic components if the mechanical advantage mechanism was not used.

3. Another object of this invention is to provide a joystick with improved linearity between angular rotation of the joystick shaft and the digital output readings.

4. A further object of this invention is to incorporate all electronic functions into a single, low cost, commercially available microcomputer in such a way that the possibility of failing to count some very rapid encoder pulses, or some pulses arriving simultaneously from multiple axes, is greatly reduced.

5. Yet another object is to provide a joystick that can output absolute position information to a system computer's serial or parallel port without any external interface circuitry.

6. An additional object is to utilize the logical capabilities of the joystick's internal microcomputer in such a way as to correct deficiencies that could arise from hysteresis in some of the optoelectronic components as well as from small variations in mechanical properties from one joystick to another.

7. A final object is to provide a joystick that can be replaced in the field without any adjustment or recalibration of any kind.

Further objects and advantages of the present invention will become apparent from a consideration of the drawings and ensuing description. Also, the manner of accomplishment of the preceding objectives will become clear as the present invention is described in detail. It should be pointed out that, while the present invention utilizes the well known prior art technique of incremental optical encoding, the present invention makes no claims with respect to this basic technique itself. In fact, the optoelectronic components employed in the preferred embodiment described herein are offered to the marketplace as standard products by Honeywell, Inc. Rather, the present invention improves significantly upon the application of incremental optical encoding to a one or multiple axis digital joystick by providing means for achieving the objectives cited above.

DESCRIPTION OF DRAWINGS

FIG. 2 illustrates operation of the joystick shaft restoring mechanism.

FIG. 6 illustrates the non-linearity inherent in converting rotary motion of the shaft to rectilinear motion of the encoded medium.

SUMMARY

The preferred embodiment of the present invention is a two-axis, all-digital joystick that uses a gear train in each axis to magnify the rotary motion of an incremental optical encoder disc. The result is increased digital resolution without using a higher resolution encoder disc or higher resolution, more expensive optoelectronic components. Outstanding linearity between angular rotation of the joystick shaft and the digital output is achieved by eliminating backlash and preserving rotary-only motion throughout the mechanical linkage.

All electronic functions are implemented in a low-cost, commercially available microcomputer that interfaces directly with an external system computer without any interface circuitry. The joystick can be operated very rapidly without error because the encoder pulses to be counted are fed to microcomputer inputs that store the occurrence of each pulse until the microcomputer can process them. The internal microcomputer is programmed to convert the incremental encoder signals into absolute shaft-position information in a fail-safe manner. It also corrects for hysteresis in some of the optoelectronic components as well as for minor mechanical variations from one joystick to the next. The resulting digital joystick is field replaceable without any adjustments or recalibration.

DESCRIPTION OF INVENTION

Figure 1:
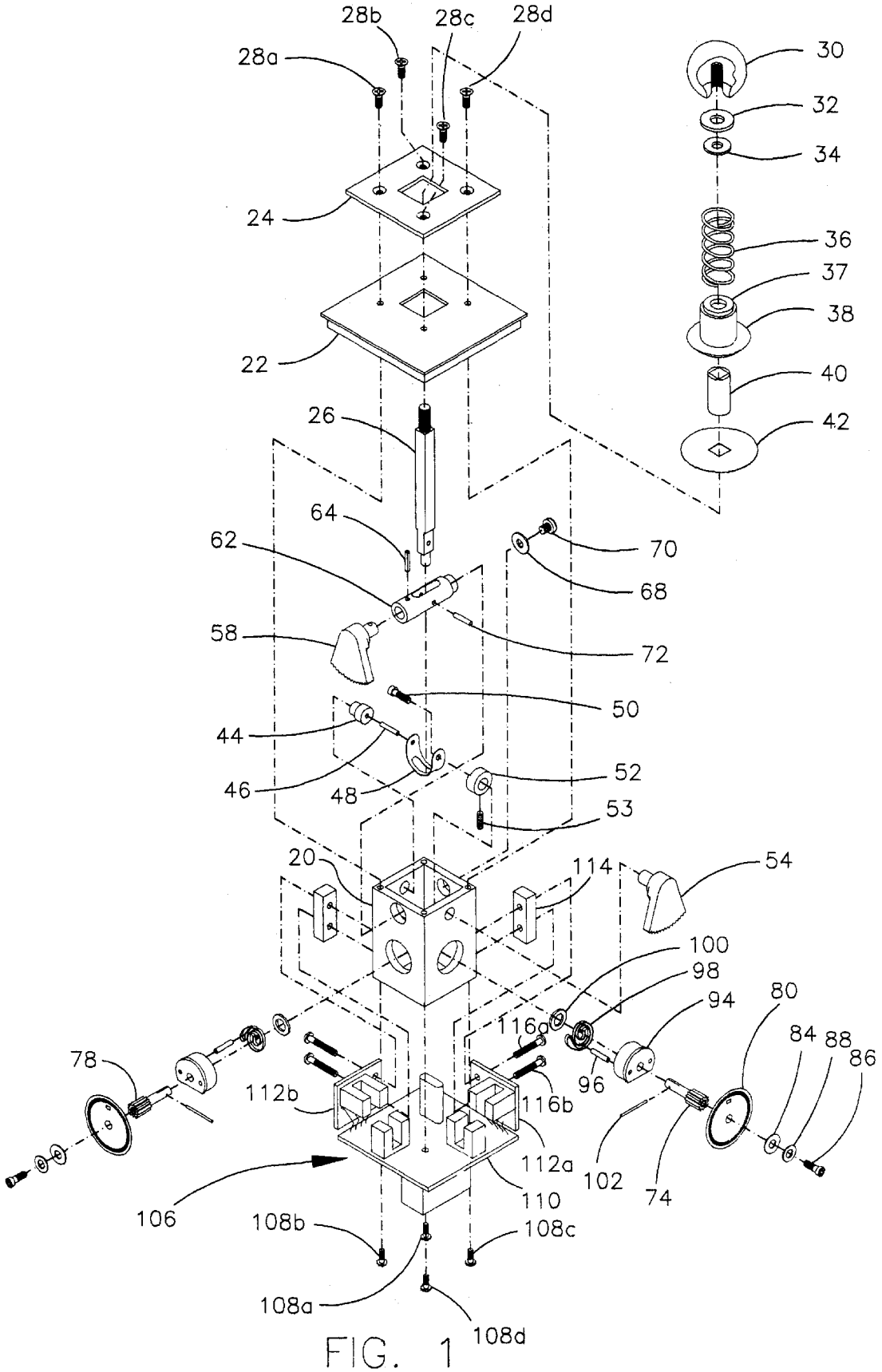
FIG. 1 is an exploded view of the complete preferred embodiment of the present invention.

FIG. 1 shows an exploded view of a preferred embodiment of the present invention. A hollow square tube 20 with a number of holes in it serves as a central supporting structure for the entire joystick. Tube 20 can be made of aluminum or other metal with holes machined in it or of a suitable plastic such as nylon with holes molded in place. A lid 22 and a stop plate 24, that limits the angular travel of a shaft 26, are atop tube 20 and attached to it by flat head screws 28*a*, 28*b*, 28*c*, and 28*d*. A mechanism for restoring shaft 26 to its neutral (vertical) position consists of a threaded knob 30, a bearing washer 32, a centering washer 34, a compression spring 36, a cam 38 with a curved base, a self-lubricating bearing 40 that is pressed into cam 38, and a thin disc 42 of some smooth easy sliding material such as teflon. The upper end of shaft 26 passes through the square openings of lid 22 and stop plate 24 and then through all the elements of the restoring mechanism and finally threads into the bottom side of knob 30, thereby clamping washers 32 and 34 against the bottom of knob 30. Knob 30 can be anything suitable for comfortable hand gripping such as a typical drawer pull.

When the restoring mechanism is assembled, spring 36 is in compression with its upper end pushing against bearing washer 32, which in turn transmits the pressure to the bottom of knob 30, and its lower end pressing against the top of cam 38. Centering washer 34 fits just inside the top coil of spring 36 and keeps that end of spring 36 centered with respect to shaft 26. The bottom end of spring 36 is captured by a centering ring 37, cut into the top of cam 38, which fits just inside the bottom coil of spring 36 and which keeps the bottom end of the spring centered.

The curved bottom of cam 38 is a bearing surface so it is best fabricated from something hard and smooth. It can be machined from stainless steel and then polished or molded of a material such as delrin. If steel is used, then a bearing 40 is needed between cam 38 and steel shaft 26. An oil-impregnated bronze bushing pressed into a central hole in cam 38 works well since it is self lubricating. Shaft 26 is square in its horizontal cross section for a reason which will be explained. Consequently, a square hole only slightly larger than the cross section of shaft 26 is broached through the center of bearing 40 and punched through the center of slider disc 42. By fitting snugly around shaft 26 and sliding between stop plate 24 and cam 38 as shaft 26 is moved, slider disc 42 keeps light and dirt and other debris out of the interior of the joystick by always covering the openings in stop plate 24 and lid 22. This makes a rubber boot, as used on many prior art joysticks, unnecessary in many applications. However, a rubber boot can be added if needed (in a harsh environment, for example).

To minimize cost it is desirable to make lid 22 out of an easy molding plastic such as a cast polyurethane. However, in the absence of separate stop plate 24, such material is not hard enough to resist denting by shaft 26 at the edges of the square opening in lid 22 if a user of the joystick presses hard on knob 30 after shaft 26 has reached its end of travel. This is particularly true if shaft 26 has a circular cross section. A square cross section, as used in the present preferred embodiment, helps to solve this problem by spreading out the area of contact between lid 22 and shaft 26. Addition atop lid 22 of stop plate 24, punched out from a thin sheet of very tough material such as polycarbonate with a square opening slightly smaller than that of lid 22, solves the denting problem completely. At end of travel, a flat side of square shaft 26 presses against a straight edge of the square opening in tough stop plate 24 so the shaft does not touch or dent the softer lid 22.

Operation of the restoring mechanism described herein is made clear by FIGS. 2*a* and 2*b*. FIG. 2*a* is a side view of the restoring mechanism with shaft 26 in its neutral (vertical) position. FIG. 2*b* shows the same mechanism with shaft 26 at one end of its range of travel and stopped from further motion by an edge of the opening in stop plate 24. Note that compression spring 36 is least compressed with shaft 26 in its neutral position (FIG. 2*a*) and most compressed with shaft 26 at its end of travel (FIG. 2*b*). It is clear that the spring and cam will force the shaft back to its neutral position whenever the knob is released. Note also that the openings in stop plate 24 and lid 22 are always covered by slider disc 42. Although FIGS. 2*a* and 2*b* show operation of the restoring mechanism only along a single axis, it is clear from FIG. 1 that the same mechanism functions in the same way along any axis and will return shaft 26 to neutral when knob 30 is released regardless of the direction of displacement of the knob from vertical.

One feature of the preferred embodiment mechanism described herein is believed to be novel. It is the combined use of a square shaft with a stop plate punched from a thin sheet of a tough material (such as polycarbonate) to limit shaft travel without denting the stopping surface, thereby permitting the more complex lid to be cast or molded from a cheap and relatively soft plastic. The advantage of this feature is that a custom lid fitting each user's packaging scheme can readily and economically be cast or molded without any other modifications to joystick design. Aside from this one feature, the claims of the present invention make no mention of a restoring mechanism since any one of a variety of prior art devices could be used. Further, the joystick described herein can be operated without any restoring mechanism with the user locating the neutral position by observing the digital outputs.

Figure 3:
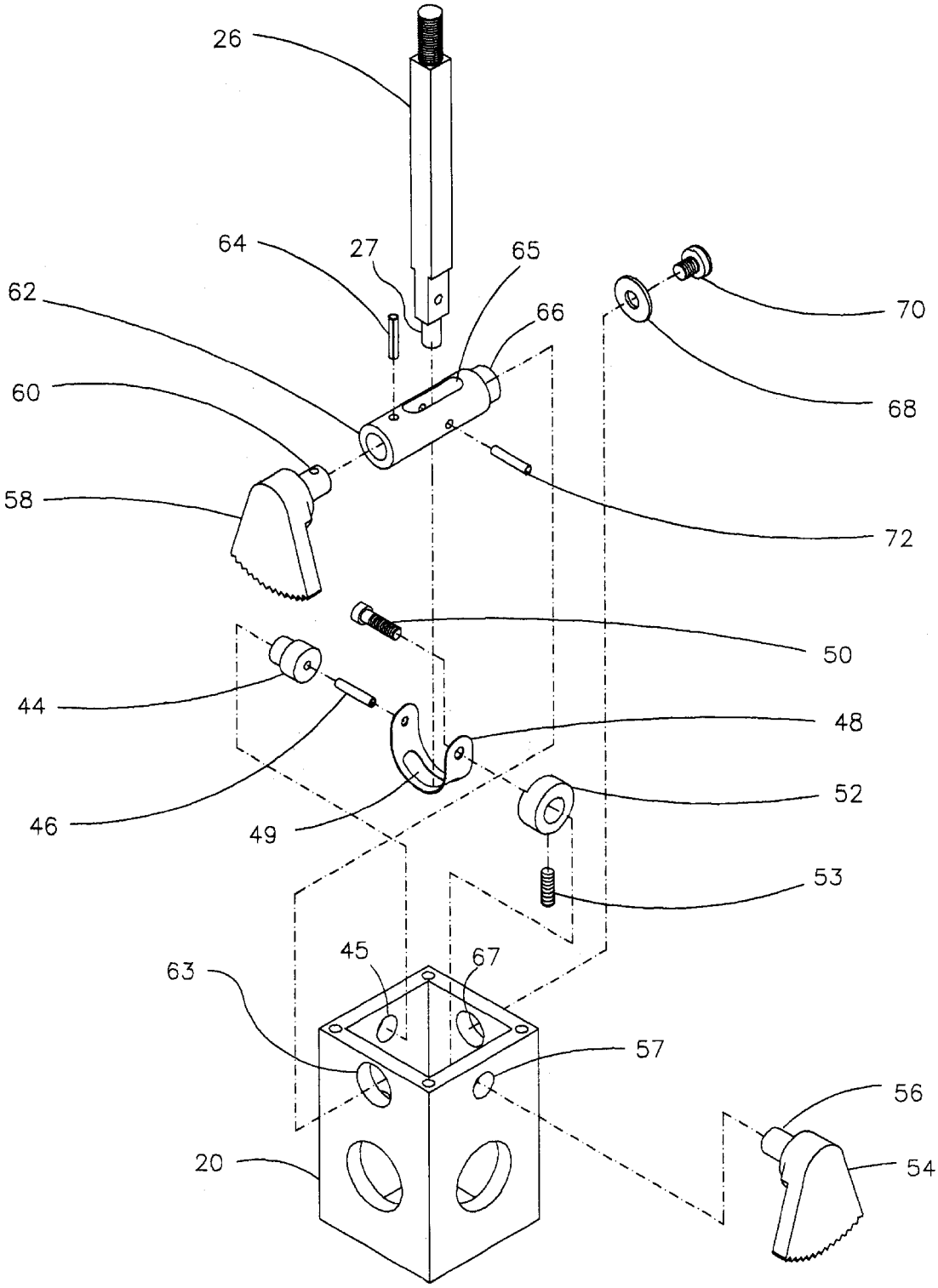
FIG. 3 is an enlargement of a portion of FIG. 1 showing the rotational linkage between joystick shaft and a first gear segment in each of two axes.

Shaft 26 must be capable of pivoting, through the full range of travel permitted by stop plate 24, about each of a pair of independent but intersecting orthogonal axes. The center of rotation is the point of intersection of the two axes. Angular rotation of the shaft about each respective axis imparts an equal angular rotation to a separate gear segment connected to each respective axis. FIG. 1 and FIG. 3 show the components involved in this action and their interconnections. FIG. 3 is simply an enlargement of a portion of FIG. 1 which makes clearer the following description of this joystick "shaft-to-gear segment" subassembly.

The components along a first axis are a swivel 44, a roll pin 46, a curved leaf spring 48, a screw 50, a collar 52 and a gear segment 54. This axis is assembled as follows. A shaft 56, with a threaded hole, that is an integral part of gear segment 54 extends through and rotates freely in a hole 57 in tube 20. Collar 52 slips over the portion of shaft 56 that protrudes beyond the inside wall of tube 20 and locks to shaft 56 via a set screw 53. Thus, gear segment 54 is mounted to a wall of tube 20 in such a way that it can rotate in hole 57. Screw 50 passes through a hole in one end of curved leaf spring 48 and threads into the tapped hole in shaft 56. This attaches spring 48 to gear segment 54 but does not guarantee that they will rotate together without any slippage. Therefore, collar 52 has a slot cut into its inward face (not shown) that is the same width as spring 48 and which tightly straddles spring 48 when screw 50 is tightened. Since collar 52 is locked to shaft 56 of gear segment 54 by set screw 53, the slot in collar 52 ensures that spring 48 rotates together with gear segment 54 without slippage. At the other end of the assembly on this first axis, roll pin 46 is pressed into a hole in the center of swivel 44 with a small portion of the roll pin protruding from the swivel. Swivel 44 is pressed into a hole 45 in tube 20 from the inside of the tube. A hole in the far end of spring 48 slips over the protruding portion of pin 46 which acts as a supporting pivot. Thus, curved leaf spring 48 is supported at one end by pin 46 and at the other end by screw 50 and is in slight compression so that it pushes outwardly against collar 52 and pivot 44, thereby holding pivot 44 in place in hole 45. Spring 48 can be photoetched or stamped from stainless steel shim stock. Pivot 44 and collar 52 are easily molded or cast from any inexpensive plastic such as polyurethane. Gear segment 54 will be discussed in detail later.

The components along a second axis, which intersects with and is orthogonal to the first axis, are; a gear segment 58, a cylindrical barrel 62, a washer 68, and a screw 70. The overall length of barrel 62 matches the outside dimension of square tube 20. Barrel 62 has an outside diameter very slightly smaller than the diameter of hole 63 in tube 20. At its far end, barrel 62 has a shoulder 66 with a still smaller diameter which, in turn, is very slightly smaller than the diameter of hole 67. Barrel 62 is slipped through hole 63 and its shoulder 66 passes into hole 67 where it is captured by washer 68 and screw 70, which threads into a tapped hole (not shown) in the center of shoulder 66. Shoulder 66 is slightly longer than the wall thickness of tube 20. Thus, barrel 62 is supported by, but can rotate freely within, holes 63 and 67 and is captured axially at one end by a wall of the tube via shoulder 66, washer 68, and screw 70. Gear segment 58 is identical with gear segment 54 except that a shaft 60, which is an integral part of gear segment 58, does not house a central tapped hole but instead has a vertical roll pin hole (not numbered). Shaft 60 is inserted into a hole in the larger end of barrel 62 and these two parts are locked together by a roll pin 64 that passes through barrel 62 and the unnumbered hole in shaft 60. Therefore, angular rotation of barrel 62 produces an equal angular rotation of gear segment 58.

The joystick "shaft-to-gear segment" subassembly of FIG. 3 is completed by installation of shaft 26 into a vertical slot 65 in barrel 62. The width of a lower rectangular portion (not numbered) of shaft 26 is narrowed so that it just slips through slot 65. Roll pin 72 locks shaft 26 into barrel slot 65 by passing through the center of barrel 62 and through the lower rectangular portion of shaft 26. The very bottom portion of shaft 26 is a tip 27 with a circular cross section that extends beyond barrel 62 and through (and a little beyond) a slot 49 in leaf spring 48. Tip 27 has a diameter very slightly less than the width of slot 49 so the tip can move along the length of slot 49 without binding and still be a close fit. Barrel 62 needs to be strong since it supports any load placed on the joystick knob and shaft by the user. A good choice is to machine the barrel out of brass since it won't bind or gall in holes 63 and 67 of tube 20 if the tube is made of aluminum.

Holes 45 and 57 in tube 20 have a common centerline defining a first axis; specified earlier by components 44, 46, 48, 50, 52, and 54 which are positioned along this first axis. Likewise, holes 63 and 67 have a common centerline defining a second axis; specified earlier by components 58, 62, 68, and 70 which are positioned along this second axis. These two axes intersect at right angles at the center of square tube 20. The point of intersection is the point about which shaft 26 can rotate in any direction. When shaft 26 rotates about this point along the first axis, barrel 62 is driven by roll pin 72 and rotates through an equal angle about the second axis and imparts the same angular travel to gear segment 58. This action imparts no motion to gear segment 54 because tip 27 of shaft 26 moves parallel with slot 49 in leaf spring 48. Similarly, when shaft 26 rotates along the second axis about the point of intersection of the two axes (rotating about roll pin 72 in slot 65 of barrel 62), tip 27 of shaft 26 moves perpendicular to slot 49 in leaf spring 48 causing spring 48 to rotate through an equal angle. This transmits the same angular travel to gear segment 54 but imparts no motion to gear segment 58 because shaft 26 moves parallel to slot 65 in barrel 62.

Thus, the two axes are independent and each component of shaft rotation is matched by an equal rotation of the corresponding gear segment. The same result can be achieved by means other than employed in the preferred embodiment shown in FIG. 3. The mechanisms disclosed in U.S. Pat. No. 4,731,530 (Mikan) and U.S. Pat. No. 4,142,180 (Burson) employ a spherical ball joint and do not drive gear segments but do have the capability to provide a pair of orthogonal output shafts with the rotation of each output shaft matching the corresponding component of rotation of the joystick shaft. The claims of the present invention are not dependent upon the particular scheme employed to achieve output shaft rotations matching the corresponding components of rotation of the joystick shaft and any mechanism accomplishing this end can be employed without affecting the novelty or limiting the scope of the present invention.

Figure 4:
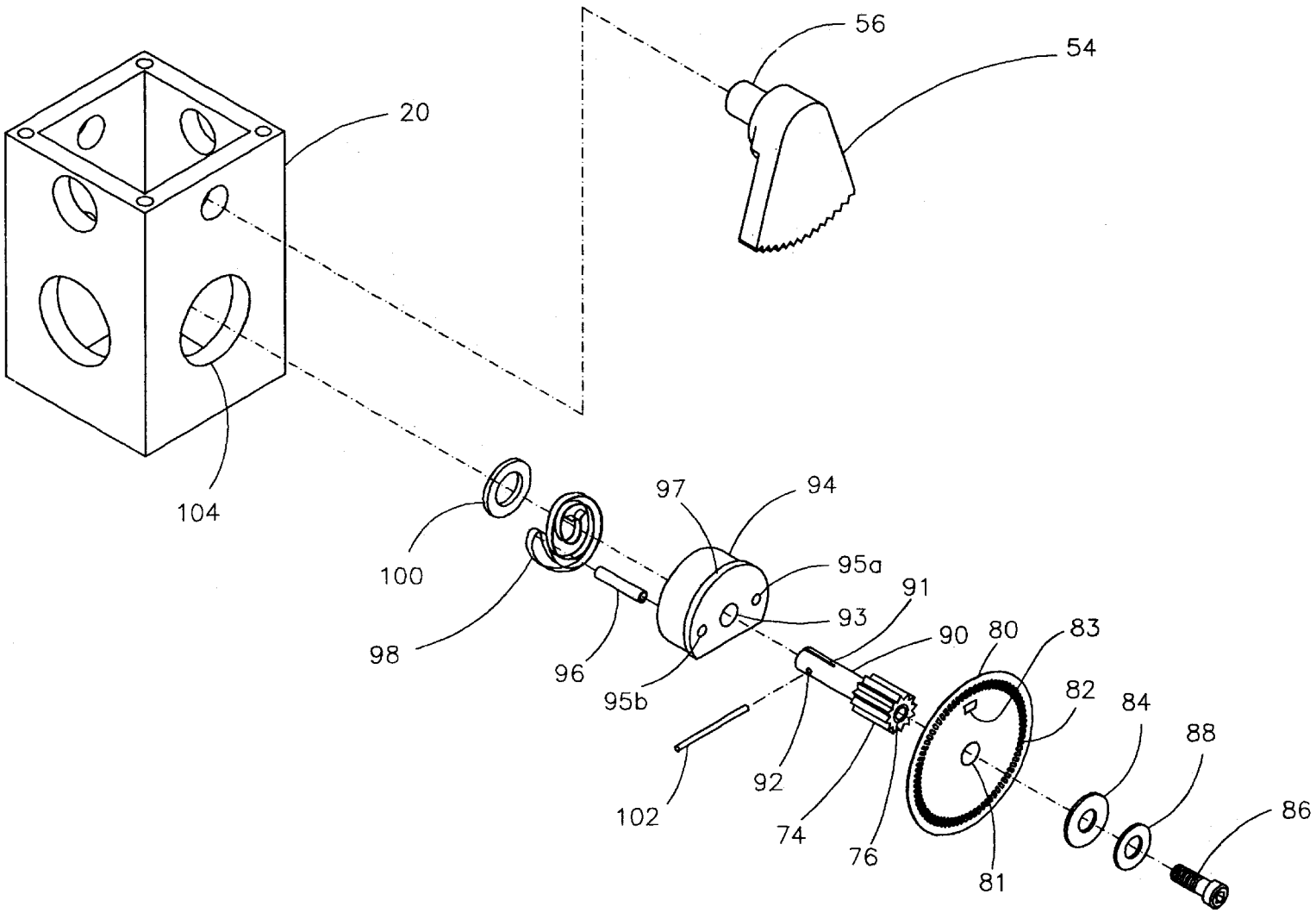
FIG. 4 is an enlargement of a portion of FIG. 1 showing details of the anti-backlash subassembly.

When the joystick of FIG. 1 is assembled, gear segment 54 engages and drives a first small gear 74 and gear segment 58 engages and drives a second and identical small gear 78. Each small gear is coupled to and drives its own encoder disc and its own anti-backlash subassembly as shown in FIG. 1 and as will be explained. From this point onward, the two axes of the joystick are identical so only only one axis is described. It is shown in FIG. 4 which is an enlarged portion of FIG. 1.

Small gear 74 has an integral shaft 90 with a narrow slot 91 cut radially through a portion of its length and a small hole 92 drilled radially through shaft 90 perpendicular to slot 91 near the end of the shaft. Shaft 90 is inserted into and rotates freely in a hole 93 in a bushing 94 with hole 92 and most of slot 91 protruding from the far side of bushing 94. A roll pin 96 is pressed into an off-center hole **95*b* in bushing 94 with a portion of roll pin 96 protruding from the far side of bushing 94. A thin ribbon 98 of stainless steel is looped over roll pin 96 and a very short section of each open end of the ribbon is crimped about 90 degrees and the portion of each end that is adjacent to the crimp is inserted into slot 91. When wound up, ribbon 98 becomes a double layer spring, with the closed end of the ribbon looped over roll pin 96 and the two open ends captured in slot 91. However, before winding ribbon 98, it must be contained axially. Washer 100 slips snugly over shaft 90 and fits just on the near side of hole 92. A pin 102 passes through hole 92 and is bent after insertion in the manner of a cotter pin to keep washer 100 captured on shaft 90. Hence, ribbon 98 is confined in a channel formed between washer 100 and the far side of bushing 94. With ribbon 98 thus contained axially, small gear 74 is wound in one direction until ribbon 98 is only a couple of revolutions from its end of travel. In this condition, ribbon 98 forms an anti-backlash spring that applies torque to small gear 74 in a direction which, if released, would unwind ribbon 98 and gear 74. Further, this assembly holds gear 74 against the near face of bushing 94 thereby preventing axial movement of the gear and an encoder disc 80 which will be attached to the gear. Also, in this wound condition, ribbon 98 has a smaller diameter than a hole 104 in tube 20 so that bushing 94 can be pressed into hole 104**.

Care must be taken in this press fit operation to prevent ribbon 98 from unwinding and to avoid pressing directly on small gear 74 which might damage it. This is best accomplished with the aid of a simple fixture (not shown) which attaches to bushing 94 via dowel pins in the fixture which insert into holes **95*a* and 95*b* in the bushing. The fixture also has a short section of gear rack which engages a few teeth of small gear 74 on its underside to prevent it from unwinding. The thickness of the gear rack is made a little greater than the axial length of the teeth of gear 74 so that a hand press can apply pressure to the gear rack and in turn to the near face of bushing 94 without touching small gear 74. As bushing 94 is thus pressed into hole 104 its travel is stopped when flange 97 contacts the outer face of tube 20. The final step is to engage gear segment 54 with the upperside teeth of small gear 74 so that the fixture can be removed without permitting ribbon 98** to unwind.

At its outer end, small gear 74 has a concentric hub 76 which just fits through a center hole 81 in an encoder disc 80. Hub 76 has a threaded center hole (not numbered). A clamp washer 84 also fits over and extends a little beyond hub 76. A small screw 86 passes through a washer 88 and through clamp washer 84 and threads into hub 76. When screw 86 is tightened, it presses on washer 88 which presses on washer 84 which clamps encoder disc 80 securely to the end of gear 74 where disc 80 is centered by hub 76 in hole 81. Thus, encoder disc 80 rotates exactly with small gear 74.

Figure 5:
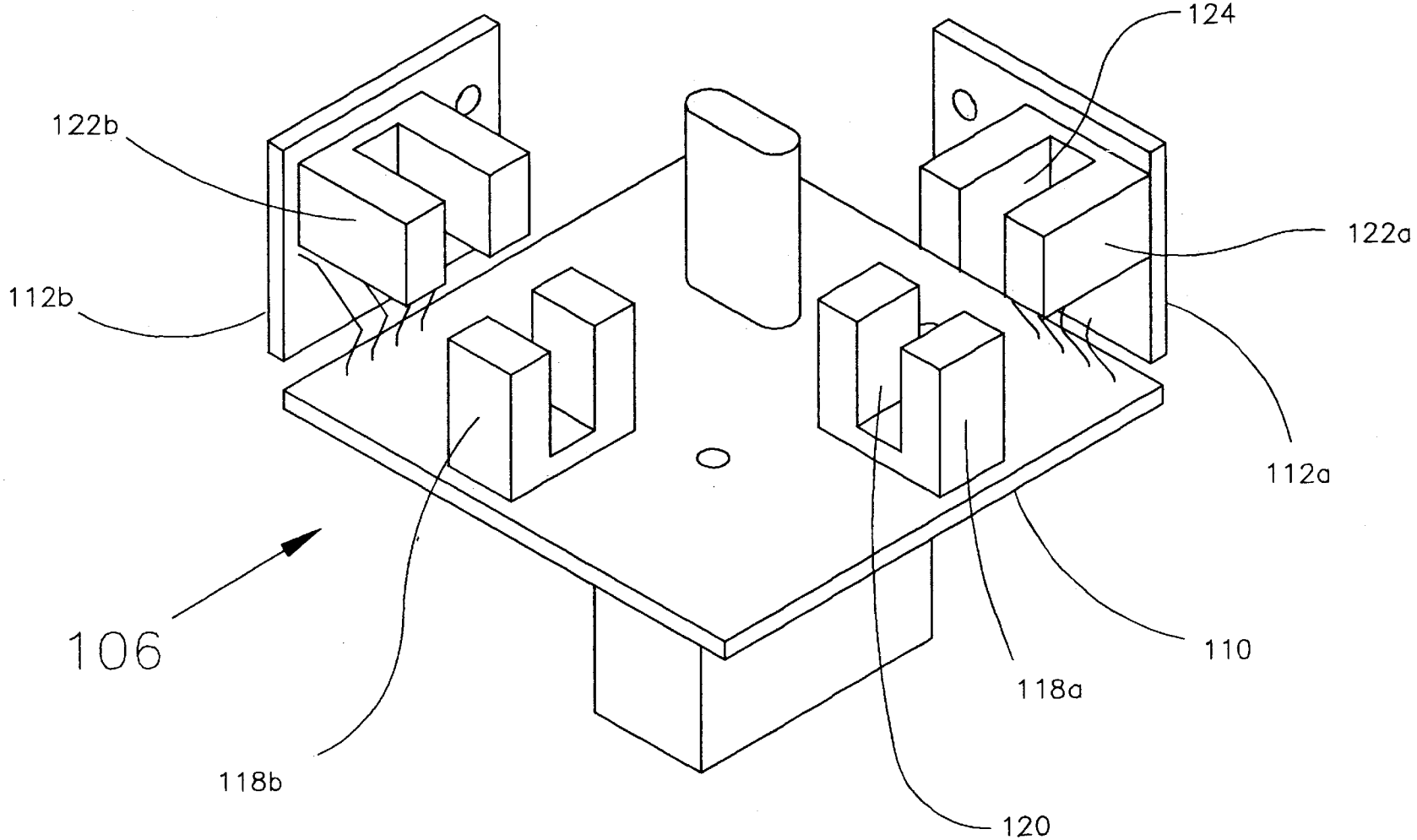
FIG. 5 is an enlargement of a portion of FIG. 1 showing the electronic subassembly containing the optoelectronic sensors.

An electronic subassembly 106 is shown in FIG. 1 and an enlarged view of it is presented as FIG. 5. As shown in FIG. 1, subassembly 106 is attached to the bottom of tube 20 by means of screws 108*a*, 108*b*, 108*c*, and 108*d*. FIGS. 1 and 5 show that subassembly 106 is comprised of a main circuit board 110 and a pair of identical small circuit boards 112*a* and 112*b*. FIG. 1 shows that small board 112*a* is attached to tube 20 via a spacer 114 and a pair of screws 116*a* and 116*b* which pass through holes in small board 112*a* and through matching holes in spacer 114 and thread into tapped holes (not shown) on a hidden face of tube 20. It is clear that small board 112*b* is attached to the other hidden face of tube 20 in the manner just described. Both small boards are perpendicular to main board 110 and connected electrically to it via a plurality of short jumper wires which are partially illustrated in FIG. 5 but not numbered.

Referring now to FIG. 5, main board 110 has installed on it an identical pair of packaged optical assemblys 118*a* and 118*b*. Optical assembly 118*a* consists of a light emitting diode (LED) and a phototransistor separated by a U-shaped opening 120. In the preferred embodiment described herein, optical assembly 118*a* is a device available as a standard product from Honeywell, Inc. It is their model HOA0971-N55 optoschmitt buffer. Its logic output is low when the light beam is interrupted and is high otherwise. The purpose of optical assembly 118*a* is to clear a counter, that tracks joystick shaft motion, whenever the shaft is in the neutral (vertical) position. Functionally equivalent devices are available from numerous other manufacturers. Further, an unpackaged LED and phototransistor can serve the same purpose. Any such device can be used without affecting the novelty or scope of the present invention.

Small board 112*a* has installed on it an encoder assembly 122*a* that is physically similar to optical assembly 118*a* in that it is comprised of a packaged light source and packaged photodetectors separated by a U-shaped opening 124. However, encoder assembly 122*a* provides directly all of the logic signals needed to implement incremental optical encoding when its light beam is interrupted by an encoder disc. These signals are a direction signal and a pulse train with the number of pulses directly proportional to the movement of the encoder disc. In the preferred embodiment described herein, encoder assembly 122*a* is a device available as a standard product from Honeywell, Inc. It is their model HOA0902-011 optical encoder assembly. Similar devices are available from other manufacturers. Further, as known in the prior art, discrete LEDs and phototransistors used in conjunction with an encoder disc can generate a pair of pulse trains which are 90 degrees apart in electrical phase. These phase-related pulse trains can be processed electronically to generate the signals required for incremental optical encoding. Any device or method can be used to generate the signals needed for incremental optical encoding without affecting the novelty or scope of the present invention.

As shown in FIG. 4, encoder disc 80 has an outer ring 82 made up of a plurality of radial slots and an inner ring with a once-around opening 83 which spans circumferentially a few of the slots in outer ring 82. Encoder disc 80 can be fabricated as a photographic negative (or positive) or photoetched from a thin piece of stainless steel. Through the use of photographic techniques the slots in outer ring 82 can be spaced with excellent linearity. This is quite advantageous as will be explained later. When the joystick of the present invention is assembled fully, encoder disc 80 of FIG. 4 is inserted into U-shaped openings 120 in optical assembly 118*a* and 124 in encoder assembly 122*a*. Dimensions are adjusted such that encoder assembly 122*a* scans along outer ring 82 to generate the electrical signals needed for incremental optical encoding and optical assembly 118*a* addresses the inner ring containing once-around opening 83 to generate a reset pulse that clears the counter which tracks motion of encoder disc 80 whenever once-around opening 83 passes through slot 120. This completes mechanical assembly of the preferred embodiment.

Every digital optical encoder has a limit on its resolution related to the density of openings or slots that can be placed on the encoder disc or strip and to the ability of the sensing device to read that pattern accurately. Higher resolution invariably comes at a higher price. For example, in the case of the present preferred embodiment employing a very low cost encoder assembly, the manufacturers's specifications for encoder assembly 122*a* state that an encoder disc with a 0.011 inch slot and 0.013 inch opaque bar between slots is recommended for maximum resolution. This permits a maximum of 104 slots on an encoder disc ring of 0.80 inch diameter as used in the preferred embodiment. A larger encoder disc can be used but would force the complete joystick to be larger. Ergonomic considerations limit travel of joystick shaft 26 to about +or −30 degrees. If shaft 26 was coupled directly to encoder disc 80, as would be the case without the gear train consisting of gear segment 54 and small gear 74, travel of the encoder disc would be limited to 17 complete slots. If 3 slots are reserved to create a neutral dead band, a reasonable minimum, then disc travel is reduced to +or −7 slots. This dead band is a region around the vertical shaft position in which the counter driven by the encoding components always reads zero. Encoder assembly 122*a* produces 2 pulses (counts) for each slot because it is able to output an electrical pulse on the rising edge and on the falling edge of each light pulse. The net result without the gear train of the present invention is 14 counts in each direction of shaft travel which is slightly less than 4-bit resolution in each direction (less than 5-bit overall).

On the other hand, in accordance with the teachings of the present invention, gear segment 54 and small gear 74 can be selected to better exploit the capabilities of encoder disc 80 and encoder assembly 122*a*. For example, a gear ratio of 8 permits the encoder disc to travel 240 degrees in each direction as the joystick shaft is moved 30 degrees in each direction. If, as before, three slots are reserved to create a neutral dead band, then 135 counts are produced in each direction. This is better than 7-bit resolution in each direction (better than 8-bit overall). This is a very practical result if the pulses are to be counted by an 8-bit microcomputer as used in the preferred embodiment. This will be discussed in more detail later. It is important to note that this dramatic improvement in resolution from less than 5-bits overall to better than 8-bits overall is achieved without altering the encoder disc or the optoelectronic components in any way. Mechanically magnified motion of the encoder disc is exploited in lieu of using higher resolution, higher cost optoelectronic components.

Still more impressive results can be achieved by raising the gear ratio further and enlarging the encoder disc some while leaving the other optoelectronic components unchanged. For example, an encoded track with a diameter of 1.10 inches can accommodate 143 slots without altering the other optoelectronic components. A gear ratio of eleven gives the sensors access to 262 slots as the shaft travels a span of 60 degrees. The net result, after subtracting 3 slots for the dead band, is 259 counts in each direction (better than 8-bit resolution in each direction and better than 9-bit resolution overall).

Other gear ratios and other encoding components can be used without departing from the basic concept presented here. Furthermore, this concept can be implemented in other ways and extended beyond the examples given here, as will be discussed shortly.

Use of a high gear ratio does not present problems in the present invention for two reasons. First, there is no load on the gear train except a very small friction load from the bearing surfaces. Hence, the user of the joystick does not sense any increased difficulty in moving its shaft 26 as a result of the presence of the gear train. Secondly, the anti-backlash subassembly of FIG. 4 removes slop in the gear train which could otherwise act to offset the resolution improvement derived from use of the gear train. The anti-backlash spring 98 can be relatively weak since it needs only to overcome the very slight friction in the bearing surfaces. Hence, the joystick user and the much stronger shaft restoring spring 36 are unaware of the presence of the anti-backlash spring 98. Furthermore, the absence of significant shock or other loading on the gear train makes it practical to fabricate the gears out of cheap, relatively weak plastic such as polyurethane.

Gear segment 54 is a partial gear rather than a complete gear for a couple of reasons. A complete gear would protrude above and interfere with lid 22. If, as in the case of the preferred embodiment described herein, the travel of shaft 26 is limited to 30 degrees in each direction then gear segment 54 needs to be only a little more than one sixth of a complete gear. Such a gear segment could be rotated through nearly 60 degrees in each direction before it bumped into lid 22. A second reason for using gear segments has to do with minimizing the size of the complete joystick. When shaft 26 in FIG. 1 is moved directly away from the viewer, gear segments 54 and 58 move toward each other. For any fixed displacement of shaft 26 in the prescribed direction, the larger the angle that gear segments 54 and 58 subtend, the larger tube 20 must be in its horizontal dimensions to prevent the two gear segments from touching each other. Therefore, gear segments 54 and 58 should span no greater angle than required by the shaft travel selected.

One other advantage stems from the use of gear segment 54 and small gear 74. They move encoder disc 80 down below the level of lid 22. Without the use of this gear train the center of encoder disc 80 would have to be positioned at the same vertical level as the center of rotation of shaft 26. The result would-be that encoder disc 80 would protrude above lid 22.

The structure of FIG. 1 has another important advantage that should be stressed. It produces exceptionally good linearity between angular rotation of shaft 26 and the pulse count emanating from encoder assembly 122*a*. As pointed out earlier, the appropriate component of shaft rotation is matched exactly by rotation of gear segment 54. Since backlash is eliminated, the rotation of small gear 74 is equal to the rotation of gear segment 54 multiplied by the gear ratio chosen. Further, rotation of encoder disc 80 matches exactly the rotation of small gear 74. Therefore, rotation of encoder disc 80 is an accurate multiple of the appropriate component of shaft rotation. Finally, since encoder disc 80 uses photographic techniques to achieve excellent linearity of slot positioning, the joystick of FIG. 1 exhibits outstanding linearity.

This is not true of prior art joysticks that convert rotary motion of the shaft to rectilinear motion of a slider plate of some kind that transports the encoded medium. This fact is understood readily by a study of FIG. 6 where a pivot point 126 represents the point about which a joystick shaft rotates and a vertical distance 128, also denoted by a letter H, is the separation between the pivot point and the plane upon which rectilinear motion of the encoded medium takes place. Said plane is indicated by a line segment 130, also identified as a distance X1, and by a colinear line segment 134, also identified as a distance X2. If the joystick shaft moves from vertical through an arc 132, also designated as an angle A, the encoded medium moves along line 130 through distance X1 to a point 138. Further movement of the joystick shaft through an equal arc 136, likewise designated as an angle A, moves the encoded medium along line 134 through distance X2 to a point 140. It is clear just from looking at FIG. 6 that distance X2 is greater than distance X1 even though arc 136 equals arc 132. A little trigonometry proves the point. It can be shown that:

$$X2-X1=H\times\tan(A)\times\tan(2A).$$

Since angle 2A is always less than 90 degrees its tangent is always a positive number. The same is true of angle A so the right side of the equation is always positive and X2 always exceeds X1, regardless of the size of H or A. Examples of prior art joysticks that exhibit this form of non-linearity include U.S. Pat. No. 4,958,071 (Scott-Jackson et al.), U.S. Pat. No. 4,856,785 (Lantz et al.), and U.S. Pat. No. 3,770,915 (Bennett et al.).

Those skilled in the art will recognize that there are many other ways to utilize the principle of mechanical advantage to achieve improved joystick resolution through magnified motion of the encoded medium. FIG. 7 presents a few illustrative examples but these are not meant to be an exhaustive set nor to limit the scope of the present invention in any way.

Figure 7A:
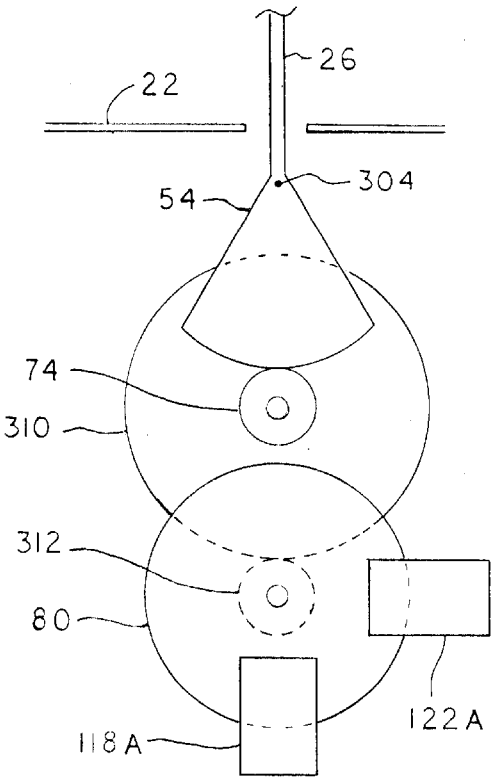
FIG. 7 illustrates several alternative schemes employing mechanical advantage to improve joystick resolution by magnifying motion of the encoded medium.

FIG. 7*a* is meant to show that multiple gears of various ratios can be used instead of a single pair as employed in the preferred embodiment. A shaft 26 passes through an opening in a lid 22 and rotates about a pivot point 304 to drive a gear segment 54. Segment 54 is engaged with a small gear 74 which is on the same shaft as a large gear 310. Gear 310, in turn, drives another small gear 312 which is coupled directly to an encoder disc 80. Optoelectronic components 118*a* and 122*a* provide the desired output signals by accessing encoded tracks on disc 80.

Figure 7B:
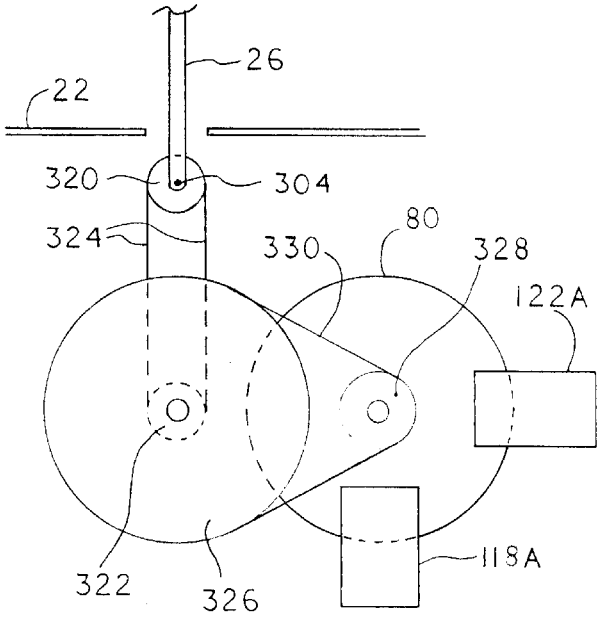

Another example is shown conceptually in FIG. 7*b* where miniature plastic chain and sprockets are used to achieve magnified motion of the encoded medium. A shaft 26 pivots about point 304 and drives a small sprocket 320 which is coupled to another small sprocket 322 by a closed loop of chain 324. Small sprocket 322 is on the same shaft as large sprocket 326. Large sprocket 326 is coupled to small sprocket 328 by another closed loop of chain 330. Small sprocket 328 is coupled directly to encoder disc 80. Again, disc 80 is read by optoelectronic sensors 118*a* and 122*a* to generate the output signals. The miniature chains and sprockets of FIG. 7*b* can be replaced with small timing belts and timing belt pulleys without altering the concept presented. Even "O" rings and grooved pulleys can be substituted without concern for slippage because there is only a very small friction load on the linkage mechanism between shaft 26 and encoder disc 80.

Figure 7C:
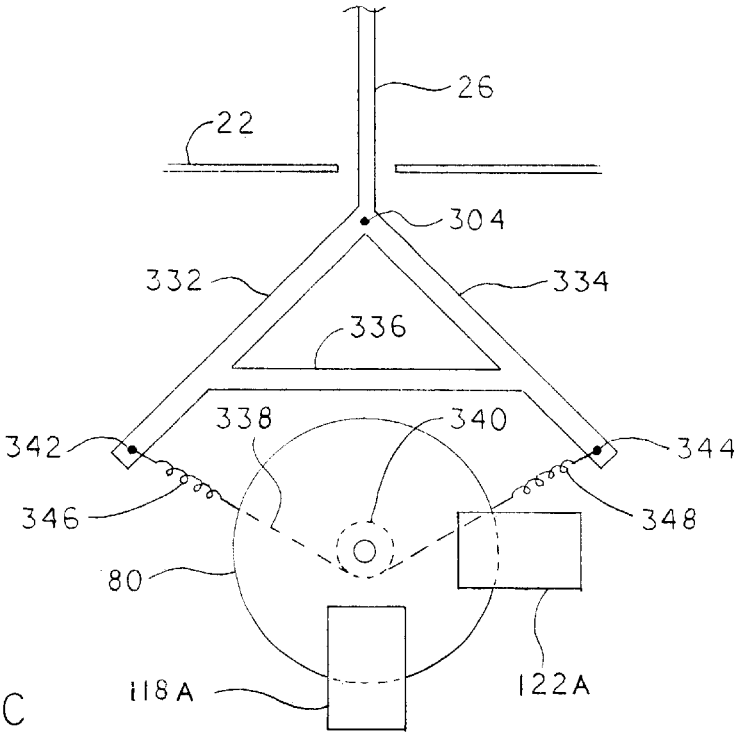

Another concept is presented in FIG. 7*c* where shaft 26 pivots about point 304 and drives a pair of rigid arms 332 and 334 that are maintained at a fixed separation in some manner such as via a rigid cross member 336. A flexible timing belt 338 passes over a timing belt pulley 340 that is coupled directly to encoder disc 80. The ends of timing belt 338 are attached to a pair of coil springs 346 and 348 which in turn are connected to the lower ends of rigid arms 332 and 334 at points 342 and 344. Springs 346 and 348 keep timing belt 338 in tension so that slack does not develop as the ends of belt 338 approach pulley 340. As before, the timing belt and pulley can be replaced with a miniature chain and sprocket or with a partial "O" ring (or other elastic band) and appropriate pulley. In fact, the springs 346 and 348 can be eliminated if there is enough stretch in the partial "O" ring or other elastic band.

Alternatively, rigid cross member 336 can be replaced with a spring in compression if shaft 26 is attached rigidly only to arm 332 while arm 334 is allowed to pivot freely at point 304 relative to arm 332. Tension is thus maintained on belt 338 without springs 346 and 348 by the pressure of the new spring (replacing cross member 336) against arms 332 and 334 tending to separate them.

It is interesting to note that the scheme of FIG. 7*c* results in some loss of linearity due to the spring action involved but the concepts of FIGS. 7*a* and 7*b* preserve excellent linearity. It is clear that there are many alternate ways of achieving magnified motion of the encoded medium without departing from the teachings of the present invention. This completes the presentation of the mechanical features of the present invention.

Figure 8:
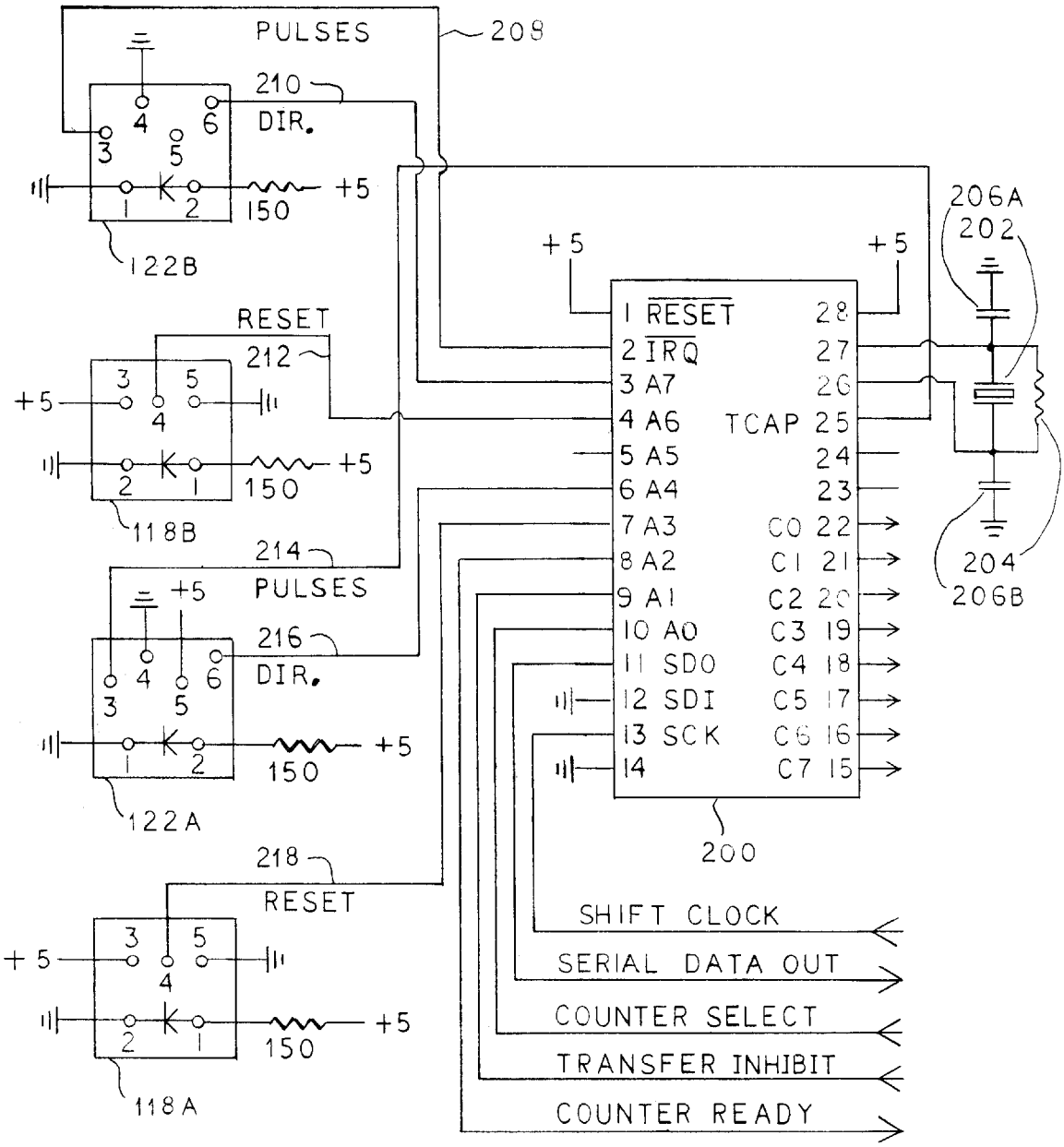
FIG. 8 is a schematic of the complete electronics of the preferred embodiment.

A schematic of the electronics required to complete the joystick of the present invention is shown in FIG. 8. Note the simplicity of the circuit. All signals from the four optoelectronic devices (118*a*, 118*b*, 122*a*, and 122*b*) are fed to a small, low cost, single-chip microcomputer (MPU) 200 that is available on the market as a standard product. All numbers inside the rectangular boxes of FIG. 8 correspond with pin numbers of the actual devices used in the preferred embodiment. The particular MPU selected for the preferred embodiment is the Motorola MC68HC705P9CDW. A number of other MPU's available as standard products from a variety of manufacturers could be used equally well without departing from the concepts that follow. In fact, any one of a variety of digital processing circuits selected from a group consisting of microprocessors and microcomputers and programmable logic arrays and custom integrated circuits could be used to implement the concepts of the present invention.

MPU 200 has its own on-board clock oscillator but requires an external crystal 202, an external resistor 204, and a pair of external capacitors 206*a* and 206*b* to complete the circuit. MPU 200 operates with a maximum clock freqency of 4 megaHertz but faster MPU's are available.

The signals resulting from shaft motion along the second mechanical axis defined earlier, which produces rotation about the first axis, are a negative-going stream of pulses on a line 214, a direction signal on a line 216, and a reset signal on a line 218. The pulses on line 214 and the direction signal on line 216 are generated by encoder assembly 122*a* as slots 82 of encoder disc 80 of FIG. 4 pass through channel 124 of FIG. 5. The reset pulse on line 218 of FIG. 8 is generated by optical assembly 118*a* as once-around opening 83 of encoder disc 80 of FIG. 4 passes through slot 120 of FIG. 5. The reset pulse is high when the joystick shaft 26 is in the neutral dead band and low otherwise.

The negative-going stream of pulses on line 214 of FIG. 8 is routed to the timer-input-capture pin (pin 25 also labeled TCAP) of MPU 200 which is programmed to recognize a negative-going edge and set an input capture flag (ICF) in the timer status register (TSR). The main program loop in MPU 200 increments or decrements a software counter for this axis if, and only if, this internal flag is set. The number of pulses on line 214 is directly proportional to the angular rotation of joystick shaft 26 about the first mechanical axis.

The direction signal on line 216 and the reset pulse on line 218 are routed to a pair of input pins of parallel port A of MPU 200. The direction signal on line 216 tells MPU 200 whether to add or subtract the current pulse from its on-going count. The reset pulse on line 218 tells MPU 200 to clear the count and hold it clear until the reset pulse is no longer present. This reset pulse creates the neutral dead band discussed earlier.

The signals resulting from shaft rotation around the second joystick axis; appearing on lines 208, 210, and 212; are just like those from the first axis with one important exception. The pulses on line 208 are routed to the interrupt request pin (pin 2) of MPU 200 where a negative-going edge initiates an interrupt service routine that increments or decrements a software counter.

The responses of MPU 200 to pulses at pins 2 and 25 need to be contrasted in more detail. A negative-going edge at pin 2 (the interrupt pin) sets an internal latch that remains set until MPU 200 gets around to processing this interrupt request. The pulse may be gone from pin 2 by this time but the internal latch retains the fact that a pulse occurred so the pulse is not lost. The latch is cleared automatically as soon as MPU 200 begins to process the interrupt request. Therefore, a second pulse at pin 2, that appears while MPU 200 is processing a prior pulse, sets the latch again and the occurrence of this second pulse is not lost. Most of the delay in the response of MPU 200 to an interrupt request stems from its need to load all register contents onto a stack (a location in random access memory) prior to servicing the interrupt. As will be shown, the interrupt service routine itself is very short and can be executed rapidly. Upon completion of interrupt service, all registers must be reloaded from the stack which briefly delays response to the next interrupt.

At rapid intervals, the main program loop in MPU 200 examines the input capture flag (ICF) in the timer status register (TSR) to see if a negative-going edge of a pulse has occurred at pin 25. If the ICF is set, the main program loop immediately clears the ICF and increments or decrements the appropriate software counter. This differs from the response to an interrupt in that the ICF is not cleared automatically but is cleared by a software instruction immediately following a read of the TSR that finds the ICF set. Thus, the occurrence of a pulse at pin 25 is saved by the ICF until the main program loop has time to respond. The pulse is not lost even if it is gone from pin 25 before MPU 200 reads the TSR. Clearing the ICF immediately upon discovering that it is set means that a second pulse that appears at pin 25, while MPU 200 is responding to a prior pulse, will not be lost since it will set the ICF again and await return of the main program loop.

The timer in MPU 200 could be programmed to initiate an interrupt when a pulse appeared at pin 25. In that case, response to a pulse at pin 25 would be just like the response to a pulse at pin 2, except for the need to clear the ICF. This is not done in the present invention! Responding to pulses at pin 25 in the main program loop rather than via an interrupt routine has the advantage of eliminating the delays inherent in loading and unloading the stack. The time thus saved is used in the main loop to perform other useful operations to be described.

Note that the pulse train from each axis is fed to an input pin of MPU 200 that is edge sensitive rather than level sensitive and which has the ability to set a latch or flag that retains the occurrence of even a very fleeting pulse. Contrast this with the prior art approach described earlier in which the encoder pulses are applied to the pins of a parallel port of a microcomputer. Recall that such parallel port pins are level sensitive rather than edge sensitive, have no pulse retention capability, and must be read by the software while the pulse is present to avoid losing the pulse. This is an important advantage of the present invention over the prior art that employs a programmable microcomputer. It enables the present invention to process correctly, without loss of counts, more rapid streams of pulses from both axes.

The direction signals on lines 210 and 216 and the reset pulses on lines 212 and 218 are fed to level sensitive pins at port A of MPU 200. However, these four signals are not narrow, rapid pulses that can be missed easily. Rather, they are relatively slow signals that persist long enough for the rapid software loops to read them unerringly. Clearly, it is possible for the joystick of the present invention to be operated so rapidly that pulses are missed or direction or reset signals are misread. However, the rate of shaft motion required to induce such errors in the present invention is far higher than that needed to produce errors using the microcomputer-based method of the prior art.

Figure 9A:
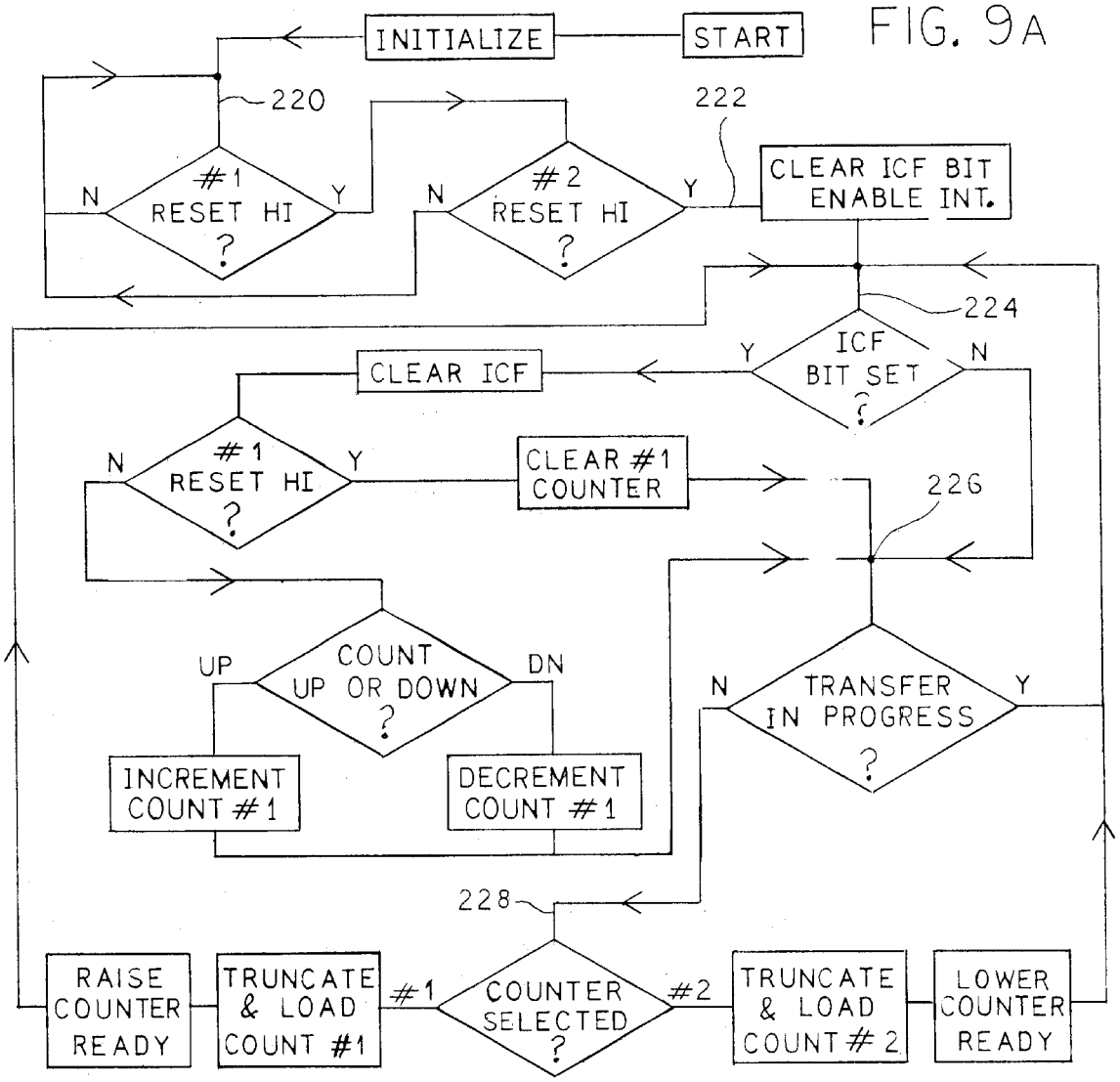
FIG. 9 is a flow chart of the programmed operation within the microcomputer of FIG. 8.
Figure 9B:
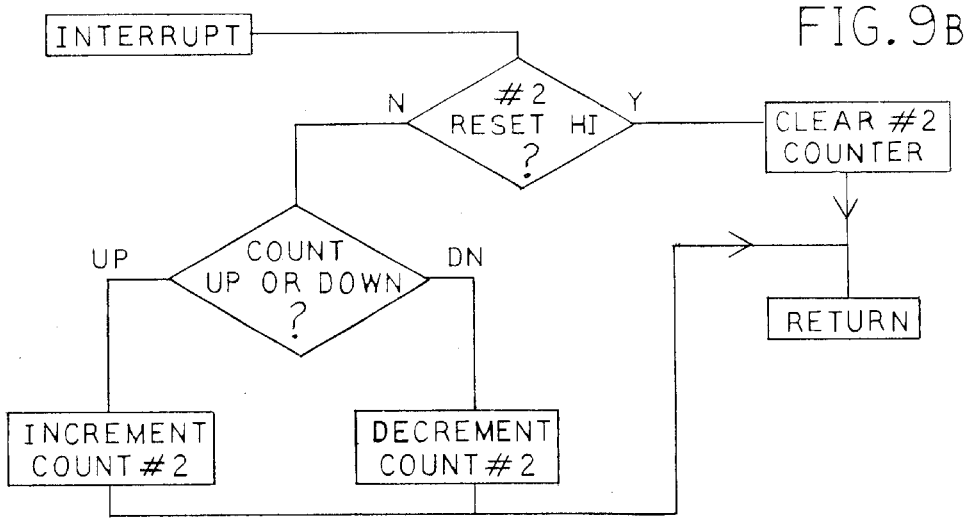

A flow chart of operation within MPU 200 is presented as FIGS. 9*a* and 9*b*. FIG. 9*a* is the main program loop and FIG. 9*b* is the response to an interrupt. Initialization upon power-up includes clearing both software counters, clearing port C used for parallel output mode, clearing the serial data register (SDR) used for serial output mode, setting port C as an output port, setting pin 8 of port A as an output pin, enabling the serial input/output function (SIOP), and setting pin 25 (TCAP) for negative-going edge capture. Following initialization, any outputs requested by a system computer interfaced to the present invention will read zero regardless of the position of the joystick shaft upon power-up. This condition persists until both reset pulses occur simultaneously, which can happen only when the joystick shaft is in the neutral dead band of both axes (vertical). On FIG. 9*a*, the main program keeps looping back to point 220 until it finds both reset pulses high. Only then can the program exit this loop at point 222.

This very simple loop has the important effect of converting the incrementally encoded signals to absolute shaft position information. This accomplishes the first object defined earlier. As a result, nothing driven by signals from the present invention will run until the joystick shaft is brought to neutral the first time after power-up. The power chair discussed earlier can't run away no matter where the shaft happens to be upon power-up.

Following point 222 on the flow chart, the ICF bit in the TSR is cleared so that the program can begin looking for pulses at the TCAP pin (pin 25) and external hardware interrupts are enabled so that the system can respond to pulses at the interrupt pin (pin 2). Then the main program loop begins at point 224. If the ICF bit is not set, no pulse has occurred so the program bypasses any action related to counter #1 and jumps to point 226. If the ICF bit is set, it is cleared immediately and the input at pin 7 of MPU 200 is read to see if a reset pulse is present. If so, counter #1 is cleared. If not, the input at pin 6 is examined to determine count direction and counter #1 is either incremented or decremented by one count and the program falls through to point 226.

At point 226 of FIG. 9*a*, pin 9 of port A (the transfer inhibit line) is read to see if the system computer is in the process of reading data from the joystick. The system computer raises this line just prior to initiating a serial transfer of data from the SDR, or to latch parallel data in the port C output register prior to a parallel read out. If pin 9 is high, the program loops back to point 224 and continues the pulse counting process without loading new data into the output registers to avoid interfering with the read out going on. If pin 9 is low, new data is loaded into the output registers. At point 228, pin 10 of MPU 200 is read to determine which counter the system computer would like to access. If pin 10 is high, MPU 200 loads data from counter #1 into parallel port C and into the SDR. If pin 10 is low, output data from counter #2 is loaded into both registers.

However, the progam does not always load the actual count. Recall that the preferred embodiment was designed to produce a few more counts than 128 in each direction. The program maintains the actual count for each axis using double precision registers if necessary but loads a number confined within the range −128 to +127. If the actual count is within this range then the actual count is loaded. If the actual count exceeds −127 then +127 is loaded. Likewise, if the actual count is less than −128 then −128 is loaded into the output registers. There are two reasons for doing this. First, port C and the SDR are 8-bit registers so numbers within the range specified can be output as a single byte. Secondly, there are inevitable minor mechanical variations from one joystick to the next such as slight differences in the size of the opening in stop plate 24 of FIGS. 1 and 2. These would otherwise result in small variations in full scale output. The result of designing for a few more counts each way than 128 but limiting the output to the range −128 to +127 is to make every joystick have the same full scale outputs at the expense of creating a very small region of "no response" at mechanical end of travel. The size of this region of "no response" is clearly under the control of the joystick designer. A major advantage of the scheme presented is to facilitate field replacement of joysticks without any recalibration since every joystick has the same full-scale outputs and behaves just like very other joystick.

Following the loading of the output registers with a truncated count from the axis selected, the main program either raises or lowers the output on pin 8 (the counter ready line) to match the input on pin 10 (the counter select line). This tells the system computer that data from the counter selected is now ready for transfer. Then the program loops back to point 224 in FIG. 9*a* to look for the next pulse at pin 25.

While the main program has been looping in the manner described, pulses from the second axis have been impinging upon pin 2. They have not been lost. Each pulse initiated the action shown in FIG. 9*b*. First, the signal on pin 4 is read to see if a reset is requested. If so, counter #2 is cleared and MPU 200 returns from interrupt. If not, pin 3 is read to determine the count direction and counter #2 is either incremented or decremented and MPU 200 returns from interrupt. Note that the interrupt routine is very brief and can be executed swiftly. During the interrupt process, all action in the main program loop is suspended temporarily with all register contents stored on and retrieved from the stack.

The system computer does a serial read out in the following sequence.

1. Raise or lower the counter select line.
2. Wait until the counter ready line matches the counter select line.
3. Raise the transfer inhibit line.
4. Initiate the transfer and output 8 shift-clock pulses.
5. Lower the transfer inhibit line.

The system computer does a parallel read out as follows.

1. Raise or lower the counter select line.
2. Wait until the counter ready line matches the counter select line.
3. Raise the transfer inhibit line.
4. Read the parallel data directly from port C.
5. Lower the transfer inhibit line.

Serial read out requires 5 lines between MPU 200 and the system computer. Parallel read out is faster but requires 11 lines. Both types of read out are fully asynchronous. No interface circuitry is needed between MPU 200 and a variety of typical system computers.

Figure 10:
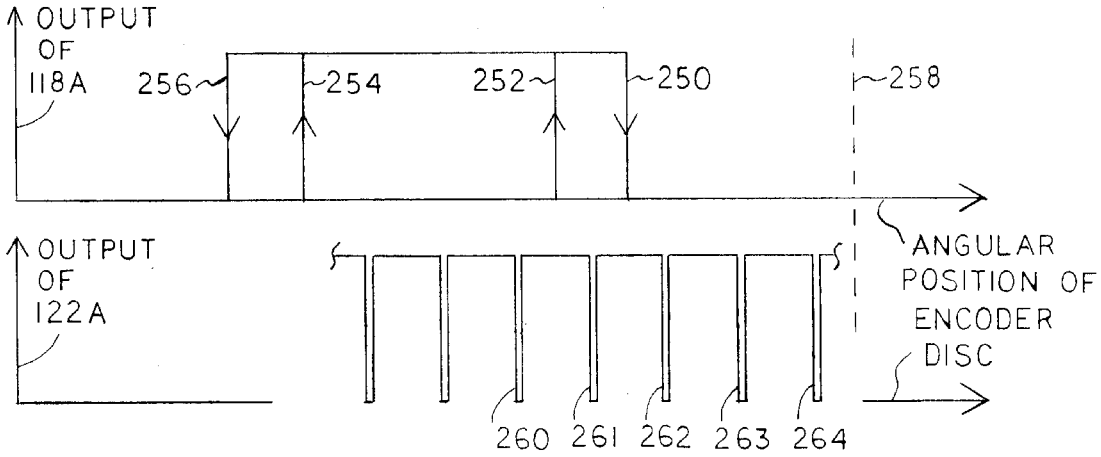
FIG. 10 illustrates hysteresis within the once-around optoelectronic sensors and its affect on pulse counting by the microcomputer.

It has been observed experimentally that optical assemblies 118*a* and 118*b* of FIGS. 5 and 8 exhibit a small amount of hysteresis which can cause a single-count error. FIG. 10 is a representation of the output voltage of optical assembly 118*a* versus the angular position of once-around opening 83 of encoder disc 80 of FIG. 4. Also shown in FIG. 10 are a few of the pulses emanating from encoder assembly 122*a* as encoder disc 80 moves through it. When once-around opening 83 is centered with respect to optical assembly 118*a* the output is high. As the once-around opening moves to the right in FIG. 10 the output drops at line 250 and remains low as once-around opening 83 moves further to the right. As once-around opening 83 retraces its path from right to left, the output does not go back high at line 250 but delays until line 252 is reached. As shown by lines 254 and 256, symmetrical behavior occurs in both directions of motion about the center of optical assembly 118*a*. Pulse 260 from encoder assembly 122*a* is never counted because the output of optical assembly 118*a* overrides it and clears the counter. Pulses 262, 263, and 264 are always counted regardless of the direction of motion of once-around opening 83 and encoder disc 80. However, pulse 261 is not counted when the encoder disc moves from left to right in FIG. 10 but is counted in the reverse direction. Suppose that left to right motion increments the counter and right to left motion decrements it. When motion is to the right, pulse 262 produces a count of one, pulse 263 increments the count to two, and pulse 264 advances the count to three at the position indicated by line 258. Reversing direction, pulse 264 decrements the count to two, pulse 263 reduces the count to one, pulse 262 drops the count to zero, and pulse 261 produces an erroneous count of minus one. This one-count error is cleared when pulse 260 is reached but a discontinuity in the count sequence has been produced. Right to left motion produced the count sequence +3, +2, +1, 0, −1, 0. This is at least annoying and could be a problem in some applications.

Fortunately, the one-count error just described can be eliminated by taking advantage of the programmability of the built-in microcomputer. MPU 200 can keep track of the count sequence by storing the prior count as well as the present count and transferring the present count to the prior count just before changing the present count. This allows MPU 200 to recognize pulse 261 of FIG. 10 and ignore it because the following conditions coexist; a count pulse just occurred, no reset pulse is present, the present count is zero, the prior count is +1, and the count direction signal is "down". These are exactly the conditions under which pulse 261 of the prior example caused an unwanted decrement of the count to −1. If the prior count was zero instead of +1 but all other conditions remained the same, then the count should be allowed to decrement to −1. This concept is flow-charted in FIG. 11 where it is expanded to cover all cases of this type.

Figure 11:
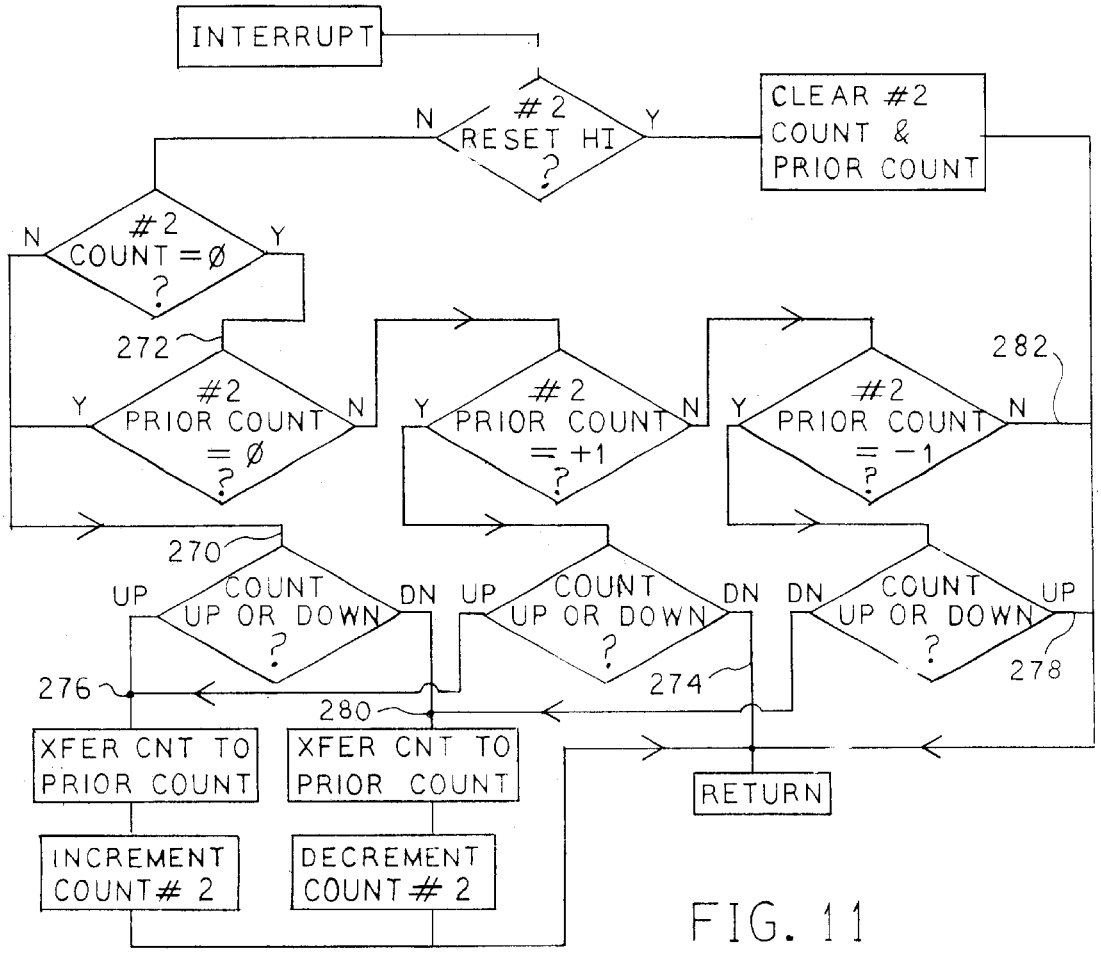
FIG. 11 is a flow chart showing how the microcomputer is programmed to correct the hysteresis of FIG. 10.

FIG. 11 is identical in function to FIG. 9*b* but corrects for hysteresis in optical assembly 118*b*. Identical adjustments to the flow chart of FIG. 9*a* can correct for hysteresis in optical assembly 118*a*. FIG. 11 shows that counter #2 and prior count #2 are both cleared if reset #2 is high. If no reset pulse is present and the present count is not zero, then normal counting takes place starting at point 270. If no reset pulse is present but the present count is zero, then it is necessary to examine the prior count beginning at point 272. If the prior count also is zero the system must be in the neutral dead band so normal counting can begin at point 270. However, if the prior count is +1 and the count direction is down the program refuses to decrement and exits at point 274. This prevents the erroneous count of −1 illustrated in the prior example. On the other hand, if the count direction is up, then the program increments normally beginning at point 276. Similarly, if the present count is zero and the prior count is −1 and the count direction is up, the program refuses to increment and exits at point 278. But, if the count direction is down, the program decrements normally beginning at point 280. Finally, if the present count is zero but the prior count is not zero or +1 or −1, then an error has occurred and the only thing to do is exit at point 282 and wait for a reset pulse to correct the error by clearing both the present and prior counts.

CONCLUSIONS, RAMIFICATIONS, AND SCOPE

Thus, the reader will see that the present invention provides a joystick that is entirely digital with all of the advantages over prior-art analog devices that are inherent in digital technology. These include, but are not limited to; freedom from drift and calibration problems, higher noise immunity, direct interfacing to computers and other digital equipment, more reliable communication with remote devices, better repeatability (for a given shaft deflection) from one reading to the next and one joystick to the next, improved overall reliability, and lower cost.

Since the present invention utilizes incremental optical encoding, it is a non-contact device with sensing elements that won't wear out. This is not true of prior-art analog joysticks employing resistive potentiometers. Furthermore, the present invention is free from the problems of contact wear, contact corrosion, contact bounce, and low resolution that plague prior-art digital joysticks using mechanically actuated electrical contacts. In addition, the present invention provides excellent linearity, unlike the non-contact analog joysticks of the prior art that use inductive or optoelectronic techniques.

The prior art has made good use of incremental optical encoding in track ball devices for controlling a cursor on a computer screen but has been deficient in applying this technology to joysticks for a couple of reasons. Unlike a track ball device (mouse), a joystick requires a fail-safe method of converting the incremental data to absolute shaft-position information. Further, prior to the present invention, a high resolution joystick required high resolution, high cost optoelectronic components. As shown in detail herein, the present invention solves both of these problems. The net result is that the present invention improves upon the prior-art application of incremental optical encoding to a joystick by:

1) providing a fail-safe means of converting the incrementally encoded data to absolute shaft position information, by forcing the outputs to remain zero until the shaft is first brought to the neutral position of both axes concurrently;

2) providing mechanical means for achieving relatively high digital resolution with relatively low resolution optoelectronic components, by magnifying the motion of the encoded medium;

3) providing means for achieving excellent linearity, by eliminating backlash and keeping all motion rotational throughout the linkage between shaft and encoder disc;

4) providing means permitting the joystick to be operated very rapidly without error, by applying the encoder pulses to microcomputer inputs capable of storing the occurrence of a pulse until the microcomputer is ready to process the pulse;

5) providing both serial and parallel digital outputs that can be read by a computer without interface circuitry; and 6) providing software means for correcting errors that could arise from hysteresis in some of the optoelectronic components or from minor mechanical variations from one joystick to the next.

A byproduct of the digital nature of the present invention combined with the software means of item 6 above is that the present invention is field replaceable without any adjustment or recalibration of any kind.

Those skilled in the art will recognize that there are many ways to mechanically magnify the motion of the encoded medium beyond those suggested herein. They will also realize that this concept applies equally well to devices that convert shaft motion, whether rotation or translation, to rectilinear motion of the encoded medium. Any method for magnifying the motion of the encoded medium can be utilized without departing from the concept or scope of the present invention.

A third axis employing the concepts of the present invention can be added to the joystick. An upper portion of the joystick shaft can be made to rotate, about its longitudinal axis, relative to a lower portion of the shaft which does not rotate about the longitudinal axis. The optoelectronic sensors are supported rigidly by the lower shaft portion. The encoder disc is supported by and rotates about the lower shaft portion in a plane normal to the longitudinal axis. The upper shaft portion rotates about the longitudinal axis and drives the encoder disc through a gear train. The first gear of the train is a bevel gear attached rigidly to the upper shaft portion in a plane normal to the longitudinal axis. The first gear drives a second bevel gear supported by the lower shaft portion and oriented with its axis of rotation perpendicular to the longitudinal axis of the shaft. The second bevel gear drives a third bevel gear that is attached to and rotates with the encoder disc about the longitudinal axis of the lower shaft portion. This third axis can be implemented in many other ways. The important point here is that the concepts of the present invention are not limited to a one or two axis joystick.

Similarly, in the electronic arena, those skilled in the art will recognize other ways to capture and store rapid pulses until they can be processed by the program. For example, microprocessors and microcomputers exist with multiple interrupt inputs. Some of them have enough interrupt inputs that every signal (or any set of signals) from the optoelectronic devices could be fed to a separate interrupt pin having pulse latching capability. This could be made to work well without departing from the concept or scope of the present invention. The scheme presented in the preferred embodiment is merely a low-cost way of achieving the desired result of, "no lost pulses."

Another idea that will occur to those skilled in electronics is to place an "OR" gate at the single interrupt input of a cheap microcomputer. Each pulse from one axis is then fed to one input of the "OR" gate and also applied to an input pin of a parallel port. Each pulse from the other axis is fed to the other input of the "OR" gate and to a different input pin of the parallel port. When an interrupt occurs, the program immediately reads the parallel port to determine which axis interrupted and desires to be counted. This and other methods can be made to work without departing from the concepts or scope of the present invention.

The possibilities for exploiting the logical capabilities of the internal microcomputer are endless. Output data can be encoded as binary or decimal or any other number system or code. Parity or any other error detection/correction scheme can be employed. The hand-shaking protocol for data exchange between the joystick and the external system computer can be any one of a long list of workable possibilities. Any such variations can be utilized without departing from the concepts or scope of the present invention.

The software of the preferred embodiment detects and corrects one type of mechanical inconsistency (that which produces variations of full-scale output) and one type of electronic defect (count sequence error due to hysteresis). Other similar problems can be detected and corrected by the internal microcomputer without departing from the concepts or scope of the present invention. For example, any change of count that exceeds one count is an error that can be detected and corrected.

Thus, it is clear that the scope of the present invention should be determined by the appended claims and their legal equivalents, rather than by the examples given herein.

I claim:

1. A digital joystick with one or more axes comprising;

an input shaft that rotates about or translates along each axis;

optoelectronic components, including an encoded medium, providing an incrementally encoded output from each axis when said encoded medium is moved;

additional optoelectronic components providing a reset pulse from each axis derived from a single small region of said encoded medium of each axis;

a digital processing circuit which receives all signals from said optoelectronic components and said additional optoelectronic components and processes them to produce a digital output from each axis that indicates the position of said input shaft about or along each axis;

a mechanical linkage for each axis that couples said input shaft to said encoded medium in such a way that motion of said input shaft on a given axis produces motion of said encoded medium of that same axis, independently of all other axes; and mechanical means within one or more of said mechanical linkages for magnifying the motion of said encoded medium relative to the corresponding motion of said input shaft;

whereby each axis incorporating said mechanical means exhibits higher digital resolution than that attainable using the same optoelectronic components without said mechanical means.

2. The joystick of claim 1 wherein, said input shaft is pivotably mounted for rotation about each axis, said encoded medium of each axis is a circular disc including a concentric ring of uniformly spaced alternating regions of tranparency and opacity, said mechanical linkage of each axis and said mechanical means provide exclusively rotary motion of all linkage components between said input shaft and said encoded medium, and further including spring activated means for eliminating backlash in said mechanical linkage and said mechanical means, whereby said joystick exhibits excellent linearity between rotation of said input shaft and said digital output of each corresponding axis.

3. The joystick of claim 1 wherein said mechanical means is a gear train.

4. The joystick of claim 3 wherein a first gear of said gear train is a gear segment rather than a complete gear, whereby said gear segment avoids interference with a lid of said joystick and the size of said joystick is minimized.

5. The joystick of claim 1 further including spring activated means for eliminating backlash in said mechanical linkage and said mechanical means, whereby the accuracy and repeatability of said digital output relative to the position of said input shaft are improved.

6. The joystick of claim 1 wherein, said shaft has a square or rectangular cross section, further including a stop plate of some tough material able to limit the travel of said shaft without denting, whereby a more complex lid supporting said stop plate can be cast or molded of some cheap plastic that would dent in the absense of said stop plate.

7. A digital joystick with one or more axes comprising;

an input shaft that rotates about or translates along each axis;

optoelectronic components, including an encoded medium, providing an incrementally encoded output from each axis upon movement of said encoded medium with said incrementally encoded output consisting of either, a direction signal and a train of pulses proportional in number to motion of said shaft on the same axis, or a pair of pulse trains shifted in phase from one another from which the signals of the preceding alternative can be derived logically;

additional optoelectronic components providing a reset pulse from each axis derived from a single small region of said encoded medium of each axis;

a mechanical linkage for each axis coupling said input shaft to said encoded medium in such a way that motion of said input shaft on a given axis produces motion of said encoded medium of that same axis, independently of all other axes; and a digital processing circuit which receives all signals from said optoelectronic components and said additional optoelectronic components and processes them to produce a digital output from each axis that indicates the position of said input shaft about or along each axis, and which further receives all of said pulse trains at inputs each having the ability to store the occurrence of a pulse until the storage mechanism is cleared by said digital processing circuit;

whereby said joystick can be operated very rapidly without error since narrow rapid pulses are not lost but are stored until said digital processing circuit can respond to them.

8. The joystick of claim 7 wherein said digital output of each axis is held at zero by said digital processing circuit following power turn-on, regardless of the position of said input shaft at time of power turn-on, until said reset pulses from all axes exist together for the first time after power turn-on, whereby said digital processing circuit converts each of said incrementally encoded signals into an absolute shaft position indication for each axis in a manner that prevents operation of said joystick until all of said digital outputs are correct.

9. The joystick of claim 7 wherein said digital processing circuit is selected from a group consisting of microprocessors and microcomputers and programmable logic arrays and custom integrated circuits and requires no interface circuitry in order to communicate said digital outputs to a wide variety of other digital processing circuits.

10. A digital joystick with one or more axes comprising;

an input shaft that rotates about or translates along each axis;

optoelectronic components, including an encoded medium, providing an incrementally encoded output from each axis upon movement of said encoded medium with said incrementally encoded output consisting of either, a direction signal and a train of pulses proportional in number to motion of said shaft on the same axis, or a pair of pulse trains shifted in phase from one another from which the signals of the preceding alternative can be derived logically;

additional optoelectronic components providing a reset pulse from each axis derived from a single small region of said encoded medium of each axis;

a mechanical linkage for each axis that couples said input shaft to said encoded medium in such a way that motion of said input shaft on a given axis produces motion of said encoded medium of that same axis, independently of all other axes; and a digital processing circuit which, receives all signals from said optoelectronic components and said additional optoelectronic components and processes them to produce a digital output from each axis that indicates the position of said input shaft about or along each axis and which, holds each of said digital outputs at zero following power turn-on, regardless of the position of said input shaft at time of power turn-on, until said reset pulses from all axes appear together for the first time after power turn-on;

whereby said joystick converts each of said incrementally encoded signals into an absolute indication of shaft position along or about each axis in a safe manner since erroneous digital outputs following power turn-on are prevented.

11. The joystick of claim 10 wherein said digital processing circuit compensates for mechanical variations from one otherwise identical joystick to another, so as to achieve identical full scale outputs, by a method, comprising the steps of;

maintaining an actual internal count for each axis that represents the position of said shaft along or about that axis; and maintaining a maximum count for each axis, selected to represent full scale, that is exceeded by said internal count of all of a group of joysticks, that are identical except for said mechanical variations, when said shaft is at its position of maximum mechanical travel along or about the same axis; and outputing said actual count when it is equal to or less than said maximum count but outputing said maximum count when said actual count exceeds said maximum count.

12. The joystick of claim 10 wherein said digital processing circuit prevents count sequence errors, otherwise caused by hysteresis in said additional optoelectronic components, by a method, comprising the steps of;

maintaining a latest actual count for each axis that represents the current position of said shaft along or about that axis; and maintaining a prior count for each axis that is the count that immediately preceded said latest actual count; and transferring said latest actual count to said prior count before incrementing or decrementing said latest actual count; and ignoring pulses, that would otherwise produce changes of said latest actual count, when said latest actual count is zero and said prior count is plus one and said count direction signal is in the decrement direction; and ignoring pulses, that would otherwise produce changes of said latest actual count, when said latest actual count is zero and said prior count is minus one and said count direction signal is in the increment direction.

* * * * *